US010392780B2

(12) United States Patent
Sugano et al.

(10) Patent No.: US 10,392,780 B2
(45) Date of Patent: Aug. 27, 2019

(54) WORK MACHINE HYDRAULIC DRIVE DEVICE

(71) Applicant: Kobe Steel, Ltd., Hyogo (JP)

(72) Inventors: Naoki Sugano, Kobe (JP); Naoto Hori, Kobe (JP); Satoshi Maekawa, Kobe (JP)

(73) Assignee: Kobe Steel, Ltd., Hyogo (JP)

( * ) Notice: Subject to any disclaimer, the term of this patent is extended or adjusted under 35 U.S.C. 154(b) by 19 days.

(21) Appl. No.: 15/755,243

(22) PCT Filed: Sep. 5, 2016

(86) PCT No.: PCT/JP2016/075964
§ 371 (c)(1),
(2) Date: Feb. 26, 2018

(87) PCT Pub. No.: WO2017/047428
PCT Pub. Date: Mar. 23, 2017

(65) Prior Publication Data

US 2018/0245312 A1 Aug. 30, 2018

(30) Foreign Application Priority Data

Sep. 18, 2015 (JP) ..... 2015-185230

(51) Int. Cl.
*F15B 11/17* (2006.01)
*E02F 9/22* (2006.01)
(Continued)

(52) U.S. Cl.
CPC ..... *E02F 9/2225* (2013.01); *E02F 9/22* (2013.01); *E02F 9/2271* (2013.01);
(Continued)

(58) Field of Classification Search
CPC ..... F15B 11/16; F15B 11/163; F15B 11/165; F15B 11/17; E02F 9/2221; E02F 9/2225; E02F 9/2228; E02F 9/2292; E02F 9/2296
(Continued)

(56) References Cited

U.S. PATENT DOCUMENTS 9,879,405 B2 * 1/2018 Saitoh ..... F15B 11/17
9,938,691 B2 * 4/2018 Hiraku ..... F15B 11/17
(Continued)

FOREIGN PATENT DOCUMENTS

JP 2014-084558 A 5/2014

OTHER PUBLICATIONS

International Search Report issued in PCT/JP2016/075964; dated Nov. 22, 2016.

*Primary Examiner* — Michael Leslie
(74) *Attorney, Agent, or Firm* — Studebaker & Brackett PC

(57) ABSTRACT

Provided is a hydraulic drive device that is provided in a work device and with which it is possible to obtain a high energy-saving effect with a low-cost configuration while being equipped with a plurality of hydraulic actuators. The hydraulic drive device is provided with: first and second actuator groups; closed circuits connected to hydraulic actuators included in the first actuator group; a pump section including closed circuit pumps; open circuits which include a plurality of variable throttle valves for changing the flow rate of working fluid supplied from a hydraulic pump included in the pump section to a hydraulic actuator; and circuit switching sections having a first state in which the closed circuits are opened and the opened circuits are blocked, and a second state in which the closed circuits are blocked and the open circuits are opened.

20 Claims, 10 Drawing Sheets

(51) Int. Cl.

| | |
|---|---|
| ***F15B 11/16*** | (2006.01) |
| ***F15B 11/02*** | (2006.01) |
| ***F15B 11/08*** | (2006.01) |
| *E02F 3/42* | (2006.01) |

(52) U.S. Cl.
CPC ..... *E02F 9/2292* (2013.01); *E02F 9/2296* (2013.01); *F15B 11/02* (2013.01); *F15B 11/08* (2013.01); *F15B 11/16* (2013.01); *F15B 11/17* (2013.01); *E02F 3/425* (2013.01); *F15B 2211/20576* (2013.01); *F15B 2211/255* (2013.01); *F15B 2211/2656* (2013.01); *F15B 2211/40515* (2013.01); *F15B 2211/634* (2013.01); *F15B 2211/6346* (2013.01); *F15B 2211/6652* (2013.01); *F15B 2211/6654* (2013.01); *F15B 2211/7053* (2013.01); *F15B 2211/71* (2013.01)

(58) Field of Classification Search
USPC ..... 60/421, 422
See application file for complete search history.

(56) References Cited

U.S. PATENT DOCUMENTS

| | | | | |
|---|---|---|---|---|
| 10,119,556 | B2 * | 11/2018 | Peterson | F15B 11/17 |
| 2013/0312399 | A1 * | 11/2013 | Hiraku | F15B 11/17 60/422 |
| 2014/0020370 | A1 * | 1/2014 | Berg | E02F 9/2296 60/327 |

* cited by examiner

WORK MACHINE HYDRAULIC DRIVE DEVICE

TECHNICAL FIELD

The present invention relates to a device for hydraulically driving a load in construction machines and the like.

BACKGROUND ART

Conventionally, as hydraulic drive devices mounted in construction machines such as a hydraulic excavator, a so-called open-circuit type one and a so-called closed-circuit type one are known.

The open-circuit type device includes a hydraulic actuator, a hydraulic pump that draws hydraulic oil in a tank to supply it to the hydraulic actuator, and a control valve interposed between this hydraulic pump and the hydraulic actuator. The above-mentioned control valve operates to control the direction and flow rate of the hydraulic oil to be supplied to the hydraulic actuator. Then, the hydraulic oil discharged from the hydraulic actuator is returned to the tank through the control valve.

Meanwhile, as disclosed in, for example, Patent Document 1, a closed-circuit type device includes variable displacement hydraulic pumps and hydraulic actuators, which are connected together to form closed circuits. The hydraulic oil discharged from the above-mentioned hydraulic pump drives the hydraulic actuator while circulating in the closed circuit.

The open-circuit type device has an advantage that a common hydraulic pump can be used to supply the hydraulic oil to a plurality of hydraulic actuators, thereby reducing the number of required hydraulic pumps. However, there is a problem that a high energy saving effect is difficult to be obtained as a pressure loss is caused by a throttle element included in a control valve which is a flow control valve.

Conversely, the closed-circuit type device does not require the control valve including a throttle element, thereby making it possible to obtain a high energy saving effect, but requires the hydraulic pump dedicated to each hydraulic actuator. Therefore, there is a problem that the number of required hydraulic pumps increases by the number of hydraulic actuators, resulting in an increase in cost. Further, in driving each hydraulic actuator, there are many cases in which the following different pumps are required; a closed-circuit pump for circulating hydraulic oil in a closed circuit, a charge pump for supplying a shortage of hydraulic oil to the closed circuit, and an open-circuit pump for eliminating a difference between the areas of a head side chamber and a rod side chamber when the hydraulic actuator is a cylinder with a rod. Owing to this, the number of required hydraulic pumps increases even more.

CITATION LIST

Patent Document

Patent Document 1: JP 2014-84558 A

SUMMARY OF THE INVENTION

An object of the present invention is to provide a hydraulic drive device which is mounted on a work machine, includes a plurality of hydraulic actuators, and is capable of obtaining a high energy saving effect with a low-cost configuration.

The provided device includes: a first actuator group including at least one hydraulic actuator; a second actuator group including at least one hydraulic actuator that is different from the hydraulic actuator included in the first actuator group; at least one closed circuit connected to each of the at least one hydraulic actuator included in the first actuator group and configured to form an oil passage through which hydraulic oil for driving the hydraulic actuator circulates; a pump section including at least one hydraulic pump for circulating the hydraulic oil in the closed circuit, the at least one hydraulic pump including a closed circuit pump, which is a variable displacement hydraulic pump provided in the closed circuit; at least one open circuit that connects at least a part of the at least one hydraulic pump included in the pump section to a plurality of hydraulic actuators included in the first and second actuator groups, the at least one open circuit including a plurality of variable throttle valves provided in the plurality of hydraulic actuators so as to change a flow rate of the hydraulic oil supplied from the hydraulic pump included in the pump section to each of the hydraulic actuators; and a circuit switching portion. The circuit switching portion has a first state in which the closed circuit is opened and the open circuit is blocked, and a second state in which the closed circuit is blocked and the open circuit is opened, the first state allowing the hydraulic actuator included in the first actuator group to be driven by the hydraulic oil circulating through the closed circuit, and the second state allowing the hydraulic oil to be supplied from the hydraulic pump connected with the open circuit, to each of the hydraulic actuators through each of the variable throttle valves.

DESCRIPTION OF EMBODIMENTS

Hereinafter, preferred embodiments of the present invention will be described with reference to the drawings.

Figure 10:
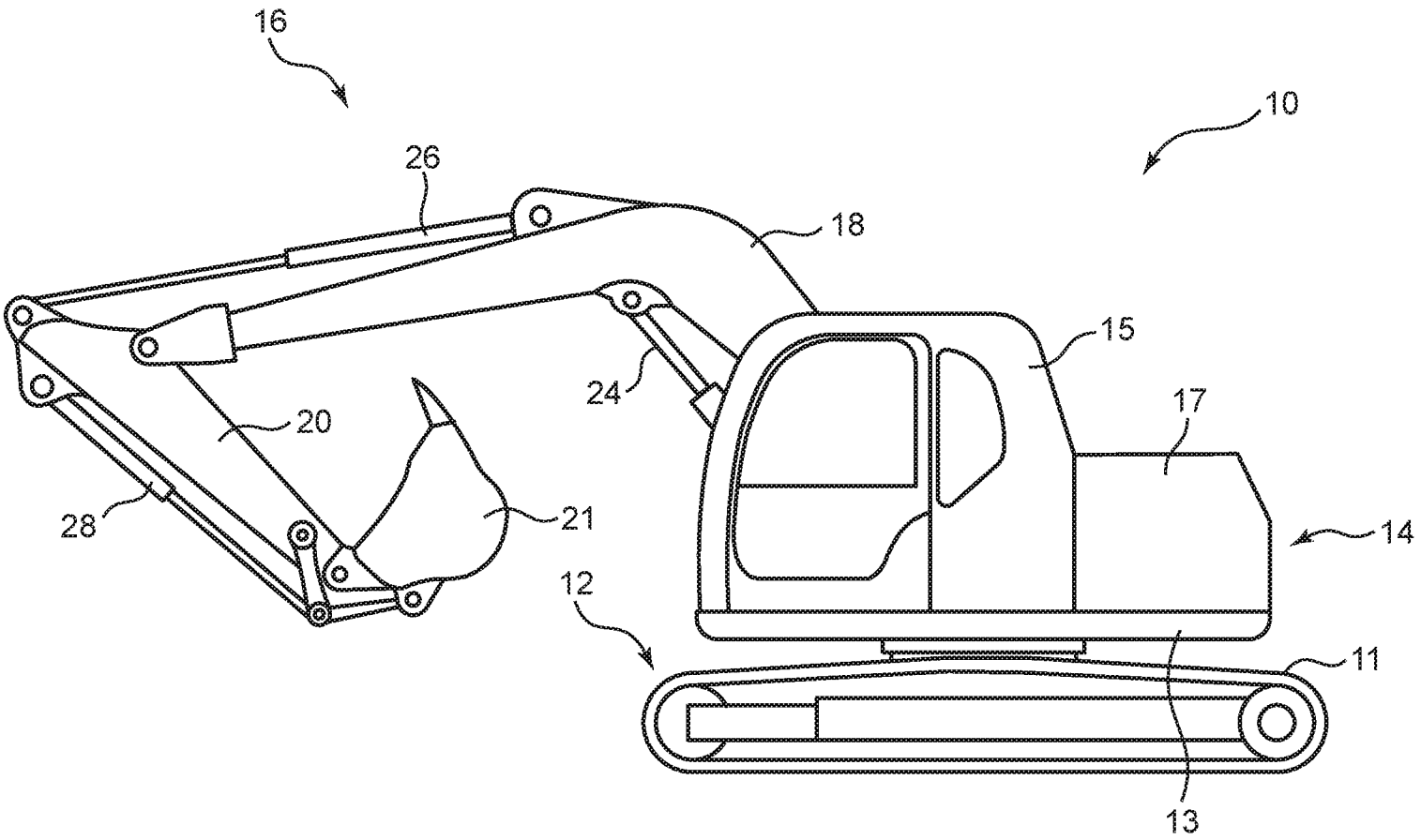
FIG. 10 is a front view showing a hydraulic excavator which is an example of a work machine on which the hydraulic drive device according to each of the above embodiments is mounted.

FIG. 10 is a diagram showing an external appearance of a hydraulic excavator 10 which is an example of a work machine on which a hydraulic drive device according to each of the embodiments described below is mounted. The hydraulic excavator 10 includes an undercarriage 12, an upper structure 14 mounted on the undercarriage 12 so that it can turn about a longitudinal axis, and a work attachment 16 which is a work device mounted on the upper structure 14. The undercarriage 12 has a travel device 11 that includes, for example, a pair of crawlers. The upper structure 14 includes a revolving flame 13, as well as a cab 15 and a counter-weight 17 which are mounted on the revolving flame 13. The work attachment 16 includes a boom 18 mounted on the upper structure 14 so that it can luff, an arm 20 rotatably coupled to the end of the boom 18, and a bucket 22 rotatably coupled to the end of the arm 20.

A boom hydraulic cylinder 24, an arm cylinder 26, and a bucket cylinder 28, which are a plurality of hydraulic actuators for work, are mounted on the work attachment 16. Each of the cylinders 24, 26, and 28 is configured by an extendible and retractable hydraulic cylinder with a rod. The boom hydraulic cylinder 24 is interposed between the boom 18 and the upper structure 14 to rotate the boom 18 in the luffing direction by the extension and retraction of the boom hydraulic cylinder through the supply of the hydraulic oil. The arm cylinder 26 is interposed between the arm 20 and the boom 18 to rotate the arm 20 about a horizontal axis with respect to the boom 18 by the extension and retraction of the arm cylinder 26 through the supply of the hydraulic oil. The bucket cylinder 28 is interposed between the bucket 22 and the arm 20 to rotate the bucket 22 about a horizontal axis with respect to the arm 20 by the extension and retraction of the bucket cylinder 28 through the supply of the hydraulic oil.

Figure 1:
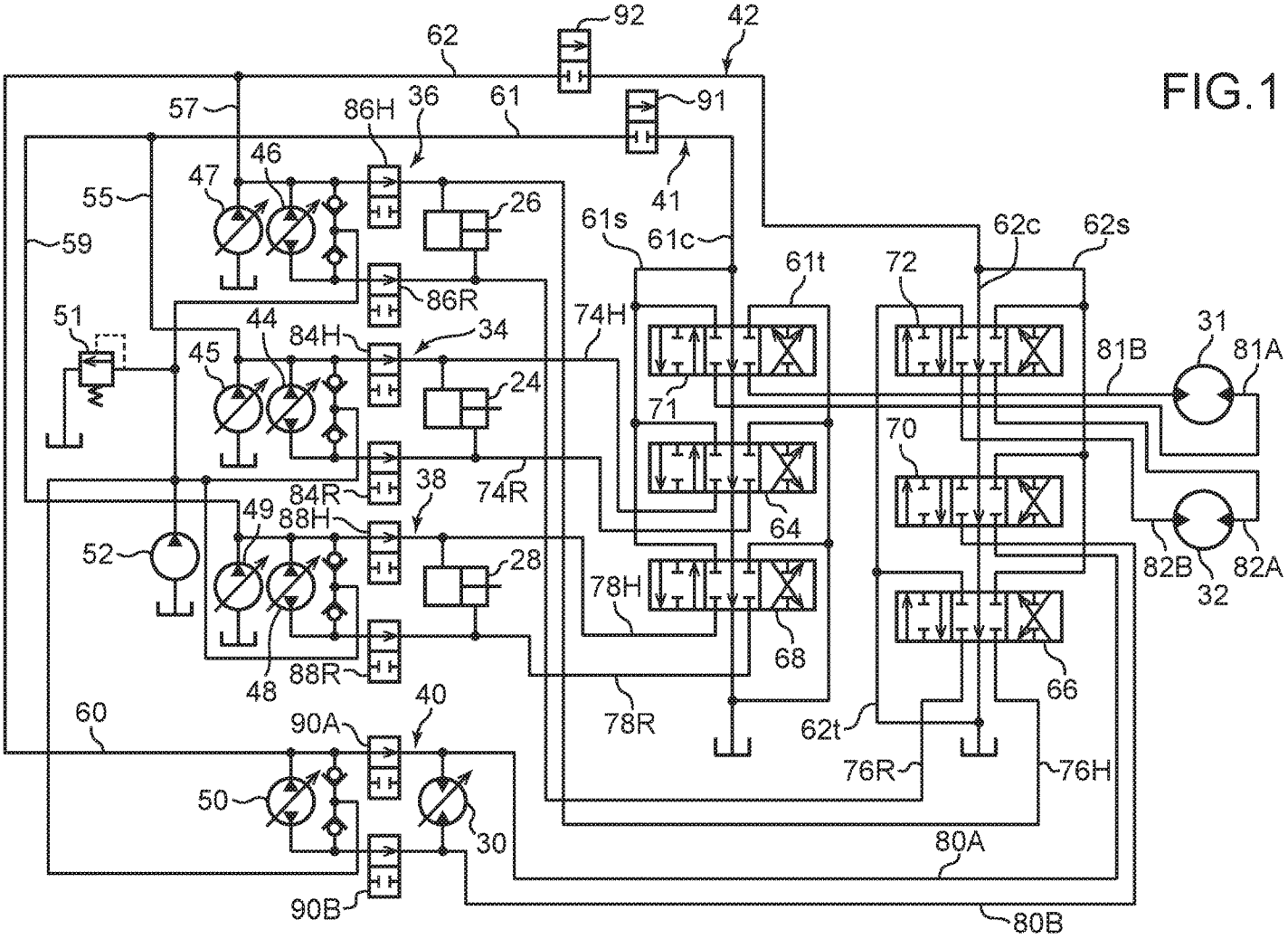
FIG. 1 is a circuit diagram showing a hydraulic drive device according to a first embodiment of the present invention.

FIG. 1 shows a hydraulic drive device according to a first embodiment of the present invention, which is mounted on the above-mentioned hydraulic excavator. This device includes, as a plurality of the hydraulic actuators, the boom hydraulic cylinder 24, the arm cylinder 26, and the bucket cylinder 28, which are the hydraulic actuators for work. In addition, this device also includes a turning motor 30 as the hydraulic actuator for turning the upper structure 14, as well as a left traveling motor 31 and a right traveling motor 32 as the hydraulic actuator for traveling, which drive left and right crawlers included in the travel device 11, respectively. Among these hydraulic actuators, the boom hydraulic cylinder 24, the arm cylinder 26, the bucket cylinder 28, and the turning motor 30 belong to a first actuator group, while both traveling motor 31 and 32 belong to a second actuator group.

Figure 3:
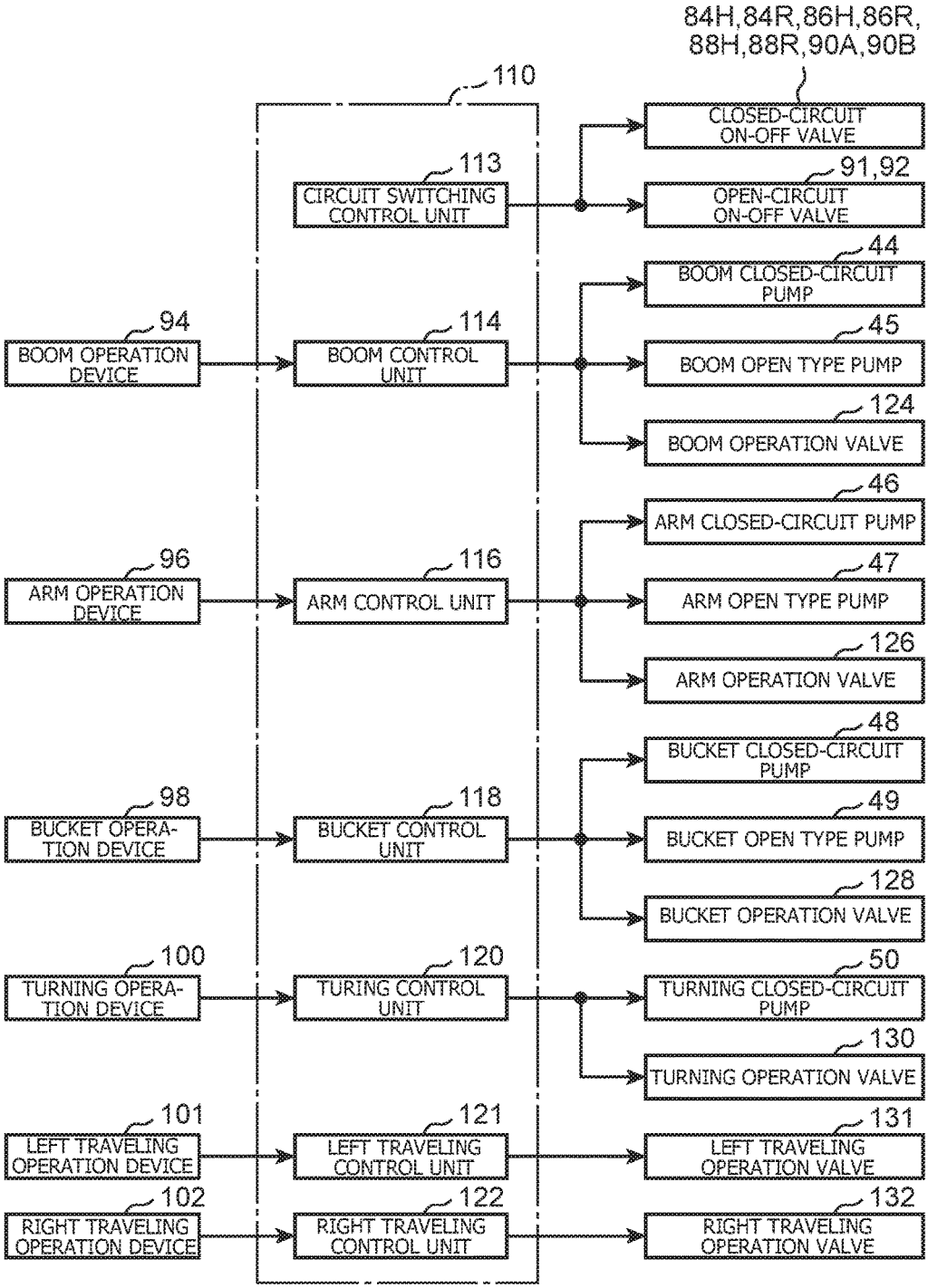
FIG. 3 is a block diagram showing a functional configuration of a controller included in the hydraulic drive device according to the first embodiment.

Besides the plurality of hydraulic actuators, this device includes a plurality of closed circuits, a pump section, a plurality of open circuits, a circuit switching portion, and a controller shown in FIG. 3. The plurality of closed circuits includes a boom closed circuit 34, an arm closed circuit 36, a bucket closed circuit 38 and a turning closed circuit 40. The plurality of open circuits includes a first open circuit 41 and a second open circuit 42.

The boom closed circuit 34, the arm closed circuit 36, the bucket closed circuit 38, and the turning closed circuit 40 are, respectively, connected to the boom hydraulic cylinder 24, the arm cylinder 26, the bucket cylinder 28, and the turning motor 30 which are included in the first actuator group, thereby forming oil passages for circulating the hydraulic oil that is used to drive the respective hydraulic actuators.

Figure 2:
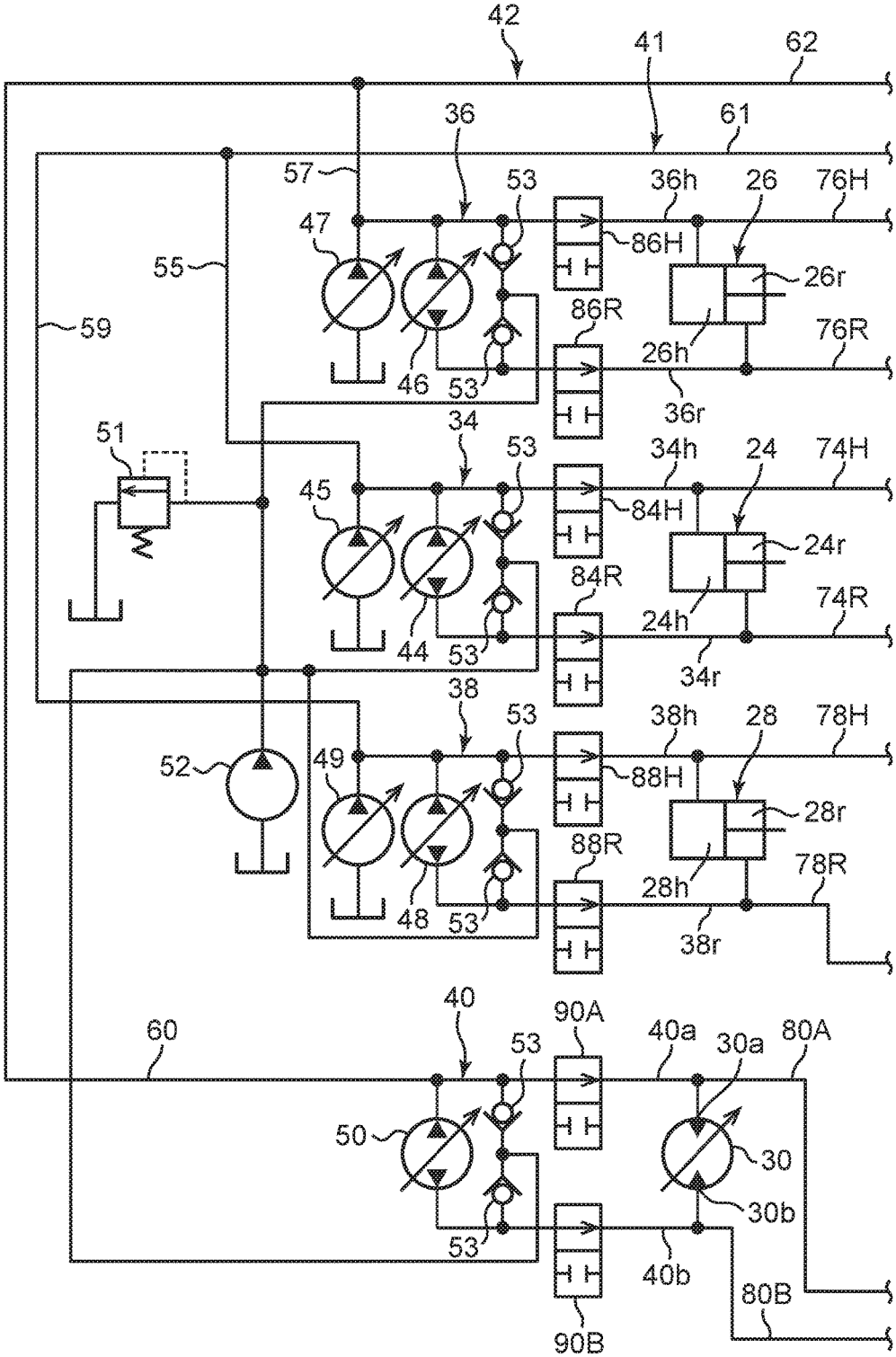
FIG. 2 is a circuit diagram showing a main part of the hydraulic drive device shown in FIG. 1.

The pump section, as also shown in FIG. 2, includes a plurality of hydraulic pumps for circulating the hydraulic oil in the respective closed circuits 34, 36, 38, and 40. Specifically, the pump section according to the present embodiment includes a boom closed-circuit pump 44, a boom open type pump 45, an arm closed-circuit pump 46, an arm open type pump 47, a bucket closed-circuit pump 48, a bucket open type pump 49, a turning closed-circuit pump 50, and a charge pump 52. A charge relief valve 51 is provided in the charge pump 52. In the present embodiment, each of the pumps 44 to 50 and 52 included in the pump section is coupled to a common engine and discharges the hydraulic oil by being driven by this engine.

The boom closed-circuit pump 44 is a variable displacement bidirectional hydraulic pump provided in the boom closed circuit 34 and operates to circulate the hydraulic oil in both directions within the boom closed circuit 34. Specifically, the boom closed-circuit pump 44 has a pair of ports, and the boom closed circuit 34 has a head side pipe **34*h* that connects one port of the boom closed-circuit pump 44 to a head side chamber 24*h* of the boom hydraulic cylinder 24, and a rod side pipe 34*r* that connects the other port of the boom closed-circuit pump 44 to a rod side chamber 24*r* of the boom hydraulic cylinder 24. Therefore, the boom hydraulic cylinder 24 operates in the extension direction, that is, in the direction of ascending the boom 18 by the circulation of the hydraulic oil, in which the hydraulic oil is supplied from the boom closed-circuit pump 44 to the head side chamber 24*h* through the head side pipe 34*h*, and returned from the rod side chamber 24*r* through the rod side pipe 34*r*. Conversely, the boom hydraulic cylinder 24 operates in the retraction direction, that is, in the direction of descending the boom 18 by the circulation of the hydraulic oil, in which the hydraulic oil is supplied from the boom closed-circuit pump 44 to the rod side chamber 24*r* through the rod side pipe 34*r*, and then returned from the head side chamber 24*h* through the head side pipe 34*h***.

The arm closed-circuit pump 46 is a variable displacement bidirectional hydraulic pump provided in the arm closed circuit 36, and operates to circulate the hydraulic oil in both directions in the arm closed circuit 36. Specifically, the arm closed-circuit pump 46 has a pair of ports, and the arm closed circuit 36 has a head side pipe **36*h* that connects one port of the arm closed-circuit pump 46 to a head side chamber 26*h* of the arm cylinder 26, and a rod side pipe 36*r* that connects the other port of the arm closed-circuit pump 46 to a rod side chamber 26*r* of the arm cylinder 26. Therefore, the arm cylinder 26 operates in the extension direction, that is, in the direction of rotating the arm 20 in the pulling direction by the circulation of the hydraulic oil, in which the hydraulic oil is supplied from the arm closed-circuit pump 46 to the head side chamber 26*h* through the head side pipe 36*h* and returned from the rod side chamber 26*r* through the rod side pipe 36*r*. Conversely, the arm cylinder 26 operates in the retraction direction, that is, in the direction of rotating the arm 20 in the pushing direction by the circulation of the hydraulic oil, in which the hydraulic oil is supplied from the arm closed-circuit pump 46 to the rod side chamber 26*r* through the rod side pipe 36*r* and returned from the head side chamber 26*h* through the head side pipe 36*h***.

The bucket closed-circuit pump 48 is a variable displacement bidirectional hydraulic pump provided in the bucket closed circuit 38 and operates to circulate hydraulic oil in both directions within the bucket closed circuit 38. Specifically, the bucket closed-circuit pump 48 has a pair of ports, and the bucket closed circuit 38 has a head side pipe **38*h* that connects one port of the bucket closed-circuit pump 48 to a head side chamber 28*h* of the bucket cylinder 28, and a rod side pipe 38***r* that connects the other port of the bucket closed-circuit pump 48 to a rod side chamber 28*r* of the bucket cylinder 28. Therefore, the bucket cylinder 28 operates in the extension direction, that is, in the direction of rotating the bucket 22 in the scoop direction by the circulation of the hydraulic oil, in which the hydraulic oil is supplied from the bucket closed-circuit pump 48 to the head side chamber 28*h* through the head side pipe 38*h*, and returned from the rod side chamber 28*r* through the rod side pipe 38*r*. Conversely, the bucket cylinder 28 operates in the retraction direction, that is, in the direction of rotating the bucket 22 in the open direction by the circulation of the hydraulic oil, in which the hydraulic oil is supplied from the bucket closed-circuit pump 48 to the rod side chamber 28*r* through the rod side pipe 38*r*, and then returned from the head side chamber 28*h* through the head side pipe 38*h*.

The turning closed-circuit pump 50 is a variable displacement bidirectional hydraulic pump provided in the turning closed circuit 40, and operates to circulate hydraulic oil in both directions within the turning closed circuit 40. Specifically, the turning closed-circuit pump 50 has a pair of ports, and the turning closed circuit 40 has a first pipe 40*a* that connects one port of the turning closed-circuit pump 50 to a first port 30*a* which is one port of the turning motor 30, and a second pipe 40*b* that connects the other port of the turning closed-circuit pump 50 to a second port 30*b* which is the other port of the turning motor 30. Therefore, the turning motor 30 operates in a direction that turns the upper structure 14 in a first direction (for example, a clockwise direction as viewed from above) by the circulation of the hydraulic oil, in which the hydraulic oil is supplied from the turning closed-circuit pump 50 to the first port 30*a* and then returned from the second port 30*b* through the second pipe 40*b*. Conversely, the turning motor 30 operates in a direction that rotates the upper structure 14 in a second direction opposite to the first direction (for example, an anticlockwise direction as viewed from above) by the circulation of the hydraulic oil in which the hydraulic oil is supplied from the turning closed-circuit pump 50 to the second port 30*b* through the second pipe 40*b*, and then returned from the first port 30*a* through the first pipe 40*a*.

Each of the open type pumps 45, 47, and 49 is composed of a variable displacement hydraulic pump, and supplies and discharges the hydraulic oil between the tank and the closed circuit so as to eliminate a difference between the cross-sectional areas of the head side chamber and the rod side chamber of the corresponding hydraulic cylinder with a rod, that is, an area difference corresponding to the cross-sectional area of the rod. Specifically, the boom open type pump 45 operates as a pump so as to supply a shortage of hydraulic oil, corresponding to the area difference, from the tank to the head side pipe 34*h* when the hydraulic oil is supplied from the boom closed-circuit pump 44 to the head side chamber 24*h* of the boom hydraulic cylinder 24 through the head side pipe 34*h*. Conversely, the boom open type pump 45 operates as a motor so as to release an excess amount of hydraulic oil, corresponding to the area difference, from the head side pipe 34*h* to the tank when the hydraulic oil is returned from the head side chamber 24*h* of the boom hydraulic cylinder 24 to the boom closed-circuit pump 44 through the head side pipe 34*h*. Similarly, the arm open type pump 47 operates as a pump so as to supply a shortage of hydraulic oil corresponding to the area difference from the tank to the head side pipe 36*h* when the hydraulic oil is supplied from the arm closed-circuit pump 46 to the head side chamber 26*h* of the arm cylinder 26 through the head side pipe 36*h*. Conversely, the arm open type pump 47 operates as a motor so as to release an excess amount of hydraulic oil corresponding to the area difference from the head side pipe 36*h* to the tank when the hydraulic oil is returned from the head side chamber 26*h* of the arm cylinder 26 to the arm closed-circuit pump 46 through the head side pipe 36*h*. Further, the bucket open type pump 49 operates as a pump so as to supply a shortage of hydraulic oil, corresponding to the area difference, from the tank to the head side pipe 38*h* when hydraulic oil is supplied from the bucket closed-circuit pump 48 to the head side chamber 28*h* of the bucket cylinder 28 through the head side pipe 38*h*. Conversely, the bucket open type pump 49 operates as a motor so as to release an excess amount of the hydraulic oil, corresponding to the area difference, from the head side pipe 38*h* to the tank when the hydraulic oil is returned from the head side chamber 28*h* of the bucket cylinder 28 to the bucket closed-circuit pump 48 through the head side pipe 38*h*.

The charge pump 52 supplies an amount of the hydraulic oil to the closed circuits 34, 36, 38, and 40 which corresponds to an amount of leakage of the hydraulic oil from the closed circuits 34, 36, 38, and 40 due to the drains or the like by the closed-circuit pumps 44, 46, 48, and 50. Specifically, the charge pump 52 is connected to the pipes 34*h*, 34*r*, 36*h*, 36*r*, 38*h*, 38*r*, 40*a*, and 40*b* of the closed circuits 34, 36, 38 and 40 via the respective charge check valves 53 to supply the hydraulic oil in the tank to the pipes through the respective charge check valves 53. Each of the charge check valves 53 prevents backflow of the hydraulic oil from each of the closed circuits 34, 36, 38, and 40 into the tank.

The first and second open circuits 41 and 42 connect the respective open pumps 45, 47 and 49 and the turning closed-circuit pump 50 of the hydraulic pumps included in the pump section to the plurality of hydraulic actuators included in the first and second actuator groups via a plurality of variable throttle valves provided for each of the plurality of hydraulic actuators, thereby making it possible to share the respective pumps 45, 47, 49 and 50 for driving the respective hydraulic actuators.

Specifically, the first open circuit 41 connects the boom open type pump 45 and the bucket open type pump 49 to the boom hydraulic cylinder 24 and the bucket cylinder 28 which are included in the first actuator group and to the left traveling motor 31 included in the second actuator group. Further, the first open circuit 41 includes a boom pump line 55, a bucket pump line 59, a main line 61, a boom control valve 64, a bucket control valve 68, a left traveling control valve 71, a head side pipe 74H and a rod side pipe 74R which are connected to the head side chamber 24*h* and the rod side chamber 24*r* of the boom hydraulic cylinder 24, respectively. The first open circuit 41 also includes a head side pipe 78H and a rod side pipe 78R which are connected to the head side chamber 28*h* and the rod side chamber 28*r* of the bucket cylinder 28, respectively, and the first pipe 81A and the second pipe 81B which are connected to opposite ports of the left traveling motor 31.

The boom pump line 55 and the bucket pump line 59 have upstream ends connected to the discharge ports of the boom open type pump 45 and the bucket open type pump 49, respectively, and downstream ends leading to the common main line 61. The main line 61 is branched into a hydraulic oil supply line 61*s* and a center bypass line 61*c* leading to the tank. The left traveling control valve 71, the boom control valve 64, and the bucket control valve 68 are provided along both lines 61*c* and 61*s* in order from the upstream side thereof. A tank line 61*t* leading to each of the control valves 71, 64, and 68 is connected to the center bypass line 61*c* on the downstream side of each of the control valves 71, 64, and 68.

Each of the control valves 71, 64, and 68 is a variable throttle valve composed of a hydraulic pilot changeover valve that has a pair of pilot ports (not shown). When the input of the pilot pressure is not received, the center bypass line 61*c* maintained in the neutral position is fully opened, and when the input of the pilot pressure is received, the control valves 71, 64, and 68 are opened with the stroke corresponding to the pilot pressure. In this way, the center bypass line 61*c* is throttled, and the hydraulic oil flowing into the hydraulic oil supply line 61*s* is guided to the corresponding hydraulic actuator through the opening space corresponding to the level of the pilot pressure. Then, the hydraulic oil discharged from this hydraulic actuator is guided to the tank line 61*t*. Specifically, the left traveling control valve 71 receives the input of the pilot pressure to one of its pilot ports, thereby guiding the hydraulic oil flowing through the hydraulic oil supply line 61*s* to the left traveling motor 31 through one of the first pipe 81A and the second pipe 81B, which corresponds to the one pilot port. Similarly, the boom control valve 64 receives the input of the pilot pressure to one of its pilot ports, thereby guiding the hydraulic oil flowing through the hydraulic oil supply line 61*s* to the head side chamber 24*h* or rod side chamber 24*r* of the boom hydraulic cylinder 24 shown in FIG. 2 through one of the head side pipe 74H and the rod side pipe 74R, which corresponds to the one pilot port. The bucket control valve 68 receives the input of the pilot pressure to one of its pilot ports, thereby guiding the hydraulic oil flowing through the hydraulic oil supply line 61*s* to the head side chamber 28*h* or rod side chamber 28*r* of the bucket cylinder 28 shown in FIG. 2 through one of the head side pipe 78H and the rod side pipe 78R, which corresponds to the one pilot port.

On the other hand, the second open circuit 42 connects the arm open type pump 47 and the turning closed-circuit pump 50 to the arm cylinder 26 and the turning motor 30 which are included in the first actuator group, and the right traveling motor 32 included in the second actuator group. The second open circuit 42 includes an arm pump line 57, a turning pump line 60, a main line 62, an arm control valve 66, a turning control valve 70, a right traveling control valve 72, a head side pipe 76H and a rod side pipe 76R which are connected to the head side chamber 26*h* and the rod side chamber 26*r* of the arm cylinder 26, respectively, a first pipe 80A and a second pipe 80B which are connected to opposite ports of the turning motor 30, and a first pipe 82A and a second pipe 82B connected to opposite ports of the right traveling motor 32.

The arm pump line 57 and the turning pump line 60 have upstream ends connected to the discharge ports of the arm open type pump 47 and the turning closed-circuit pump 50, respectively, and downstream ends connected to the common main line 62. The main line 62 is branched into a hydraulic oil supply line 62*s* and a center bypass line 62*c* which leads to the tank, in the middle of the main line 62, and the right traveling control valve 72, the turning control valve 70, and the arm control valve 66 are provided along both lines 62*c* and 62*s* in order from the upstream side thereof. Further, a tank line 62*t* leading to each of the control valves 72, 70, and 66 is connected to the center bypass line 62*c* on the downstream side of each of the control valves 72, 70, and 66.

Each of the control valves 71, 64, and 68 is a variable throttle valve and formed of a hydraulic pilot changeover valve having a pair of pilot ports (not shown). When the input of the pilot pressure is not received, the control valves 71, 64, and 68 are maintained in a neutral position to fully open the center bypass line 62*c*. Meanwhile, when the input of the pilot pressure is received, the control valves 71, 64, and 68 open with the stroke corresponding to the pilot pressure. In this way the center bypass line 62*c* is throttled, and the hydraulic oil flowing into the hydraulic oil supply line 62*s* is guided to the corresponding hydraulic actuator through an opening space corresponding to the pilot pressure. Then, the hydraulic oil discharged from this hydraulic actuator is guided to the tank line 62*t*. Specifically, the right traveling control valve 72 receives an input of the pilot pressure to one of its pilot ports, thereby guiding the hydraulic oil flowing through the hydraulic oil supply line 62*s* to the left traveling motor 32 through one of the first pipe 82A and the second pipe 82B, which corresponds to the one pilot port. Similarly, the turning control valve 70 receives an input of the pilot pressure to one of its pilot ports, thereby guiding the hydraulic oil flowing through hydraulic oil supply line 62*s* to the port of the turning motor 30 through one of a first pipe 70A and a second pipe 70B, which corresponds to the one pilot port. The arm control valve 66 receives the input of the pilot pressure to one of its pilot ports, thereby guiding the hydraulic oil flowing through the hydraulic oil supply line 62*s* to the head side chamber 26*h* or the rod side chamber 26*r* of the arm cylinder 26 shown in FIG. 2 through one of the head side pipe 76H or rod side pipe 76R, which corresponds the one pilot port.

Among the pumps 45, 47, 49, and 50, which are connected to the first and second open circuits 41 and 42, each of the open type pumps 45, 47, and 49 can directly draw the hydraulic oil in the tank and then supply it to the hydraulic actuators leading to the first or second open circuits 41, 42. On the other hand, as the turning closed-circuit pump 50 is provided in the turning closed circuit 40, the hydraulic oil in the tank cannot be directly drawn, but the hydraulic oil supplied from the charge pump 52 to the turning closed circuit 40 can be pressurized to supply the pressurized hydraulic oil to each hydraulic actuator connected to the second closed circuit 42, that is, to supply the hydraulic oil in cooperation with the charge pump 52. Therefore, the capacity of the turning closed-circuit pump 50 when supplying the hydraulic oil to the second open circuit 42 is preferably limited to a capacity equal to or less than the flow rate of the hydraulic oil which can be supplied from the charge pump 52 to the turning closed circuit 40.

The circuit switching portion enables switching of circuits to be used for supplying the hydraulic oil to the hydraulic actuators, and has a first state and a second state. The first state is a state in which the hydraulic oil circulating in the closed circuits 34, 36, 38, and 40 is, respectively, capable of driving the boom hydraulic cylinder 24, the arm cylinder 26, the bucket cylinder 28, and the turning motor 30 which are included in the first actuator group, by opening the respective closed circuits 34, 36, 38, and 40 and blocking the first and second open circuits 41 and 42. The second state is a state in which the hydraulic oil is capable of being supplied from the pumps 45, 47, 49, and 50 connected to the first and second open circuits 41 and 42 to the respective actuators through variable pressure valves, namely, the control valves 71, 64, 68, 72, 70, and 66 by blocking the respective closed circuits 34, 36, 38, and 40 and opening the first and second open circuits 41 and 42.

Specifically, the circuit switching portion includes closed-circuit on-off valves 84H, 84R, 86H, 86R, 88H, 88R, 90A, and 90B, and open-circuit on-off valves 91 and 92, and these on-off valves are configured by, for example, electromagnetic switching valves. The closed-circuit on-off valves 84H, 84R, 86H, 86R, 88H, 88R, 90A, 90B operate to switch between opening and blocking of the pipes 34*h*, 34*r*, 36*h*, 36*r*, 38*h*, 38*r*, 40*a*, and 40*b* included in the closed circuits 34, 36, 38, and 40, respectively. Further, the open-circuit valves 91 and 92 switch between opening and blocking of the first open circuit 41 and the second open circuit 42, respectively, and more specifically, switch between opening and blocking of the main lines 61 and 62, respectively. Therefore, the closed-circuit on-off valves 84H, 84R, 86H, 86R, 88H, 88R, 90A, and 90B are opened and the open-circuit on-off valves 91 and 92 are closed, thereby forming the first state. Conversely, the closed-circuit on-off valves 84H, 84R, 86H, 86R, 88H, 88R, 90A, and 90B are closed and the open-circuit on-off valves 91 and 92 are opened, thereby forming the second state.

The hydraulic drive device according to the present embodiment further includes a plurality of operation devices and a controller 110 as shown in FIG. 3. The plurality of operation devices include a boom operation device 94 provided for the boom hydraulic cylinder 24, an arm operation device 96 provided for the arm cylinder 26, a bucket operation device 98 provided for the bucket cylinder 28, a turning operation device 100 provided for the turning motor 30, and left traveling operation devices 101 and 102 provided for the left and right traveling motors 31 and 32, respectively.

Each of the operation devices 94, 96, 98, 100, 101, and 102 is provided in the cab 15, and includes an operation member that receives an operation for driving the corresponding hydraulic actuator of the hydraulic actuators, for example, an operation lever, and an operation device body which generates an operation signal corresponding to an operation given to the operation member to input the operation signal to the controller 110.

As shown in FIG. 3, the controller 110 includes a circuit switching control unit 113, and a boom control unit 114, an arm control unit 116, a bucket control unit 118, a turning control unit 120, a left traveling control unit 121, and a right traveling control unit 122, which are a plurality of actuator control units for controlling the operations of respective hydraulic actuators. Each of the plurality of actuator control units 114, 116, 118, 120, 121, and 122 can function as a capacity adjusting unit.

The circuit switching control unit 113 switches the circuit switching portion between the first state and the second state in response to an operation given to each of the operation devices 94, 96, 98, 100, 101, and 102, that is, an operation signal input from each of the operation devices 94, 96, 98, 100, 101, and 102. Specifically, when no operation is given to any of the operation devices, and when an operation is given to only the operation devices 94, 96, 98, and 100 corresponding to the hydraulic actuators included in the first actuator group (in other words, when none of the traveling operation devices 101 and 102 included in the second actuator group are operated), the circuit switching control unit 113 controls the circuit switching portion to be switched to be the first state, and when an operation is given to at least the traveling operation devices 101 and 102, the circuit switching control unit 113 controls the circuit switching portion to be switched to be the second state.

The boom control unit 114 operates the boom closed-circuit pump 44, the boom open type pump 45, and the boom control valve 64 to control the movement of the boom 18. Specifically, when the circuit switching portion is in the first state, that is, when the use of the closed circuit is selected, the boom control unit 114 sets the capacity of each of the boom closed-circuit pump 44 and the boom open type pump 45 to the capacity corresponding to the operation given to the boom operation device 94. When the circuit switching portion is in the second state, that is, when the use of the open circuit is selected, the boom control unit 114 sets the capacity of the boom closed-circuit pump 44 to 0 and adjusts the capacity of the boom open type pump 45 connected to the first open circuit 41 to an open-circuit capacity, that is, a capacity for securing the flow rate required for the supply of hydraulic oil to the hydraulic actuators through the first open circuit 41. Further, when the circuit switching portion is in the second state, the boom control unit 114 outputs a command signal to the boom operation valve 124, which is an electromagnetic proportional pressure reducing valve interposed between each pilot port of the boom control valve 64 and a pilot hydraulic pressure source (not shown), so as to operate the boom control valve 64 with a stroke corresponding to the operation given to the boom operation device 94, whereby the pilot pressure corresponding to the operation is input to the pilot port of the boom control valve 64.

The arm control unit 116 operates the arm closed-circuit pump 46, the arm open type pump 47, and the arm control valve 66 to control the movement of the arm 20. Specifically, when the circuit switching portion is in the first state, that is, when the use of the closed circuit is selected, the arm control unit 116 sets the capacity of each of the arm closed-circuit pump 46 and the arm open type pump 47 to the capacity corresponding to the operation given to the arm operation device 96. When the circuit switching portion is in the second state, that is, when the use of the open circuit is selected, the arm control unit 116 sets the capacity of the arm closed-circuit pump 46 to 0 and adjusts the capacity of the arm open type pump 47 connected to the second open circuit 42 to the open-circuit capacity, that is, a capacity for securing the flow rate required for the supply of hydraulic oil to the hydraulic actuators through the second open circuit 42. Further, when the circuit switching portion is in the second state, the arm control unit 116 outputs a command signal to an arm operation valve 126, which is an electromagnetic proportional pressure reducing valve interposed between each pilot port of the arm control valve 66 and the pilot hydraulic pressure source so as to operate the arm control valve 66 with a stroke corresponding to the operation given to the arm operation device 96, whereby the pilot pressure corresponding to the operation is input to the pilot port of the arm control valve 66.

The bucket control unit 118 operates the bucket closed-circuit pump 48, the bucket open type pump 49, and the bucket control valve 68 to control movement of the bucket 22. Specifically, when the circuit switching portion is in the first state, that is, when the use of the close circuit is selected, the bucket control unit 118 sets the capacity of each of the bucket closed-circuit pump 48 and the bucket open type pump 49 to the capacity corresponding to the operation given to the bucket operation device 98. When the circuit switching portion is in the second state, that is, when the use of the open circuit is selected, the bucket control unit 118 sets the capacity of the bucket closed-circuit pump 48 to 0 and adjusts the capacity of the bucket open type pump 49 connected to the first open circuit 41 to the open-circuit capacity, that is, the capacity for securing the flow rate required for the supply of hydraulic oil to the hydraulic actuators through the first open circuit 41. Further, when the circuit switching portion is in the second state, the bucket control unit 118 outputs a command signal to a bucket operation valve 128, which is an electromagnetic proportional pressure reducing valve, interposed between each pilot port of the bucket control valve 68 and the pilot hydraulic pressure source, so as to operate the bucket control valve 68 with a stroke corresponding to the operation given to the bucket operation device 98, whereby the pilot pressure corresponding to the operation given is input to the pilot port of the bucket control valve 68.

The turning control unit 120 operates the turning closed-circuit pump 50 and the turning control valve 70 in order to control the turning operation of the upper structure 14. Specifically, when the circuit switching portion is in the first state, that is, when the use of the closed circuit is selected, the turning control unit 120 sets the capacity of the turning closed-circuit pump 50 to the capacity corresponding to an operation given to the turning operation device 100. When the circuit switching portion is in the second state, that is, when the use of the open circuit is selected, the turning control unit 120 adjusts the capacity of the turning closed-circuit pump 50 connected to the second open circuit 42 to the open-circuit capacity, that is, the capacity for securing the flow rate required for the supply of hydraulic oil to hydraulic actuators through the second open circuit 42. In this way, the turning closed-circuit pump 50 does not have the function of directly drawing and discharging the hydraulic oil in the tank as described above, but pressurizes hydraulic oil in the turning closed circuit 40 supplied from the charge pump 52 to supply it to the second open circuit 42. Thus, the turning control unit 52 preferably limits the capacity of the turning closed-circuit pump 50 to a capacity equal to or less than the flow rate of the hydraulic oil that can be supplied from the charge pump 52 into the turning closed circuit 40.

In addition, when the circuit switching portion is in the second state, the turning control unit 120 outputs a command signal to a turning operation valve 130, which is an electromagnetic proportional pressure reducing valve interposed between each pilot port of the turning control valve 70 and the pilot hydraulic pressure source, so as to operate the turning control valve 70 with a stroke corresponding to an operation given to the turning operation device 100, whereby the pilot pressure corresponding to the operation is input to the pilot port of the boom control valve 64.

The left traveling control unit 121 and the right traveling control unit 122 operate the left traveling control valve 71 and the right traveling control valve 72, respectively, in order to control the traveling operation of the upper structure 12 when the circuit switching portion is in the second state. Specifically, the left traveling control unit 121 and the right traveling control unit 122 output command signals to a left traveling operation valve 131 and a right traveling operation valve 132, respectively, which are electromagnetic proportional pressure reducing valves interposed between the pilot ports of the left and right traveling control valves 71 and 72 and the pilot hydraulic pressure source, so as to operate the left and right traveling control valves 71 and 72 with strokes corresponding to operations given to the left traveling operation device 101 and the right traveling operation device 102, respectively, whereby the pilot pressures corresponding to the respective operations are input to the pilot ports of the left and right traveling control valves 71 and 72.

Figure 4:
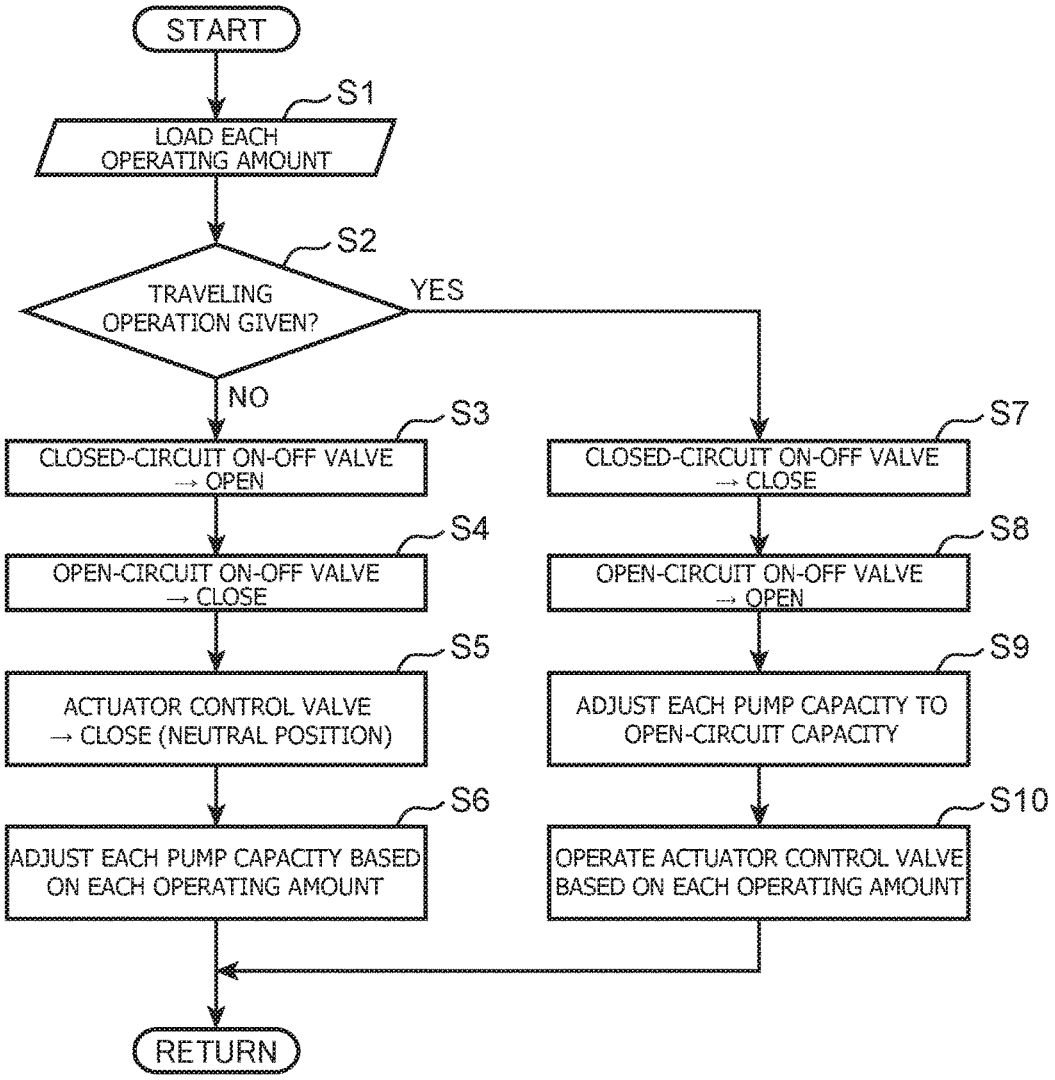
FIG. 4 is a flowchart showing a control operation of the controller.

FIG. 4 shows a specific control operation performed by the controller 110.

The controller 110 loads each operation amount (specifically, the operation amount of the operation lever, including positive and negative values corresponding to the respective operation directions) input from the above-mentioned operation devices 94, 96, 98, 100, 101, and 102 (step S1). Then, based on the operation amount, the circuit switching control and each control accompanied with the switching are performed.

Specifically, the circuit switching control unit 113 of the controller 110 switches the circuit switching portion to the first state in order to select the closed circuit as the circuit to be used under the following conditions: when no operation is given to any of the left traveling operation device 101 and the right traveling operation device 102 (NO in step S2); specifically, when the operation amounts of both operation devices 101 and 102 are equal to or less than a low threshold value that can be regarded as 0; or in other words, when no operation device is operated, or when operations are given to only the operation devices for the hydraulic actuators belonging to the first actuator group (the boom operation device 94, the arm operation device 96, the bucket operation device 98, and the pivot operation device 100). That is, the circuit switching control unit 113 opens all of the closed-circuit on-off valves 84H, 84R, 86H, 86R, 88H, 88R, 90A, and 90B to open the closed circuits 34, 36, 38, and 40 (step S3), and closes the first and second open-circuit on-off valves 91 and 92 (step S4). On the other hand, each of the actuator control units 114, 116, 118, 120, 121, and 122 of the controller 110 sets the actuator control valves 64, 66, 68, 70, 71, and 72 included in the first and second open circuits 41 and 42 that are not selected, to the neutral position (step S5).

Further, when an operation is given to at least one of the boom operation device 94, the arm operation device 96, the bucket operation device 98, and the turning operation device 100, the actuator control unit corresponding to the operation controls the capacity of the hydraulic pump related to the closed circuit in order to operate the corresponding hydraulic actuator by the closed circuit at a speed according to the operation (step S6). For example, when an operation is given to the boom operation device 94, the boom control unit 114, which is an actuator control unit corresponding to the operation, adjusts the capacity of the boom closed-circuit pump 44 in the boom closed circuit 34 such that the boom hydraulic cylinder 24 is extended and retracted at the speed corresponding to the given operation, and also adjusts the capacity of the boom open type pump 47 in order to operate the boom open type pump 47 to eliminate an area difference between the head side chamber 24*h* and the rod side chamber 24*r* of the boom hydraulic cylinder 24.

Meanwhile, when an operation is given to at least one of the left traveling operation device 101 and the right traveling operation device 102 (YES in step S2), specifically, when the operation amount of each of both operation devices 101 and 102 exceeds the threshold value, in other words, when an operation is given to only the traveling operation devices 101 and 102, or when an operation is simultaneously given to the traveling operation devices 101 and 102 and at least one of other operation devices (operation devices corresponding to hydraulic actuators that belong to the first actuator group) 94, 96, 98, 100, 101, and 102, the circuit switching control unit 113 switches the circuit switching portion to the second state in order to select the open circuit as the circuit to be used. Specifically, the circuit switching control unit 113 blocks each closed circuit 34, 36, 38, and 40 by closing any one of the closed-circuit on-off valves 84H, 84R, 86H, 86R, 88H, 88R, 90A, and 90B (step S7), and opens the first and second open-circuit on-off valves 91 and 92 (step S8).

Meanwhile, the boom control unit 114, the arm control unit 116, the bucket control unit 118, and the turning control unit 120 of the controller 110 adjust the capacities of the pumps 45, 47, 49, and 50 connected to the first and second open circuits 41 and 42 to the open-circuit capacities, that is, capacities that can drive the hydraulic actuators by the first and second open circuits 41 and 42 (step S9). Further, among the actuator control units 114, 116, 118, 120, 121, and 122, the actuator control unit corresponding to the operation device to which an operation is given, operates the actuator control valve that corresponds to the corresponding hydraulic actuator in order to operate this hydraulic actuator by the open circuit at the speed corresponding to the operation (step S10). For example, when an operation is given to both of the left traveling operation device 101 and the right traveling operation device 102, the left traveling control unit 121 and the right traveling control unit 122 open the left traveling control valve 71 and the right traveling control valve 72 by the input of command signals to the left traveling operation valve 131 and the right traveling operation valve 132 so as to rotate the left traveling motor 31 and the right traveling motor 32 at a speed corresponding to the operation, whereby hydraulic oil is supplied to the left traveling motor 31 and the right traveling motor 32 through the first open circuit 41 and the second open circuit 42.

As described above, this device includes the closed circuits 34, 36, 38, and 40 for driving the hydraulic actuators (the boom hydraulic cylinder 24, the arm cylinder 26, the bucket cylinder 28, and the turning motor 30) included in the first actuator group. The device also includes the first and second open circuits 41 and 42 for driving these actuators and the hydraulic actuators (left and right traveling motors 31 and 32) included in the second actuator group. Further, the pumps 45, 47, 49, and 50 of the hydraulic pumps included in the pump section for circulating the hydraulic oil in the closed circuits 34, 36, 38, and 40 can be applied to the open circuits 41 and 42. Therefore, regarding the left and right traveling motors 31 and 32 included in the second actuator group, it is possible to decrease the number of the pumps by eliminating the necessity of inclusion of the hydraulic pumps for the closed circuit, and also minimize the use of the variable throttle valves in the open circuits 41 and 42, namely, the actuator control valves 64, 66, 68, 70, 71, and 72. Consequently, the pressure loss generated by the variable throttle valves is reduced, thereby making it possible to obtain the high energy saving effect.

Specifically, when the traveling operation, that is, the operation of the traveling motors 31 and 32 included in the second actuator group are not performed, but only the hydraulic actuators (the boom hydraulic cylinder 24, the arm cylinder 26, the bucket cylinder 28, and the turning motor 30) included in the first actuator group are operated, the circuit switching control unit 113 of the controller 110 sets the circuit switching portion to the first state such that the operated hydraulic actuators are driven by the closed circuit. Thus, the pressure loss can be reduced by avoiding the use of the variable throttle valves (actuator control valves 64, 66, 68, 70, 71, 72) included in the open circuit, thereby making it possible to obtain the high energy saving effect.

Meanwhile, when at least the traveling operation is performed, the circuit switching control unit 113 switches the circuit switching portion to the second state, so that the left traveling motor 31 and the right traveling motor 32, which are not connected to the closed circuits, can be driven by the first and second open circuits 41 and 42, respectively. In other words, the left and right traveling motors 31 and 32 can be driven without providing pumps dedicated for the left and right traveling motors. This can reduce the cost by decreasing the number of the required pumps and can further increase the energy saving effect by reducing the energy loss that would be caused by rotation of the unused pump together with the used pump, when the plurality of pumps are connected to the common engine as described above.

The progression of the energy saving effect becomes more remarkable when the first actuator group includes at least one hydraulic actuator for work (cylinders 24, 26, and 28 in the above embodiment) and the second actuator group includes at least one hydraulic actuator for traveling (left and right traveling motors 31, 32 in the above embodiment), as in the first embodiment and the following embodiments. In other words, as the hydraulic actuator for work has a higher operation frequency than the hydraulic actuator for traveling, it is effective in terms of improving the energy saving effect to drive the hydraulic actuator for work by the closed circuit, that is, the circuit that does not the throttle element. On the other hand, when the hydraulic actuator for work and the hydraulic actuator for traveling are simultaneously driven, a pressure loss is generated by the actuator control valve that is the variable throttle valve for driving both hydraulic actuators. However, this kind of simultaneous operation of the hydraulic actuator for traveling and the hydraulic actuator for work is rare, which results in a small influence on the energy saving effect. In this way, the hydraulic actuator for traveling that has a lower demand for improving energy saving effect than the hydraulic actuator for work is included in the second actuator group, and the hydraulic pump for the closed circuit of the hydraulic actuator for traveling is used for driving the hydraulic actuator for work, which can reduce the number of the required hydraulic pumps while exhibiting the energy saving effect.

Figure 5:
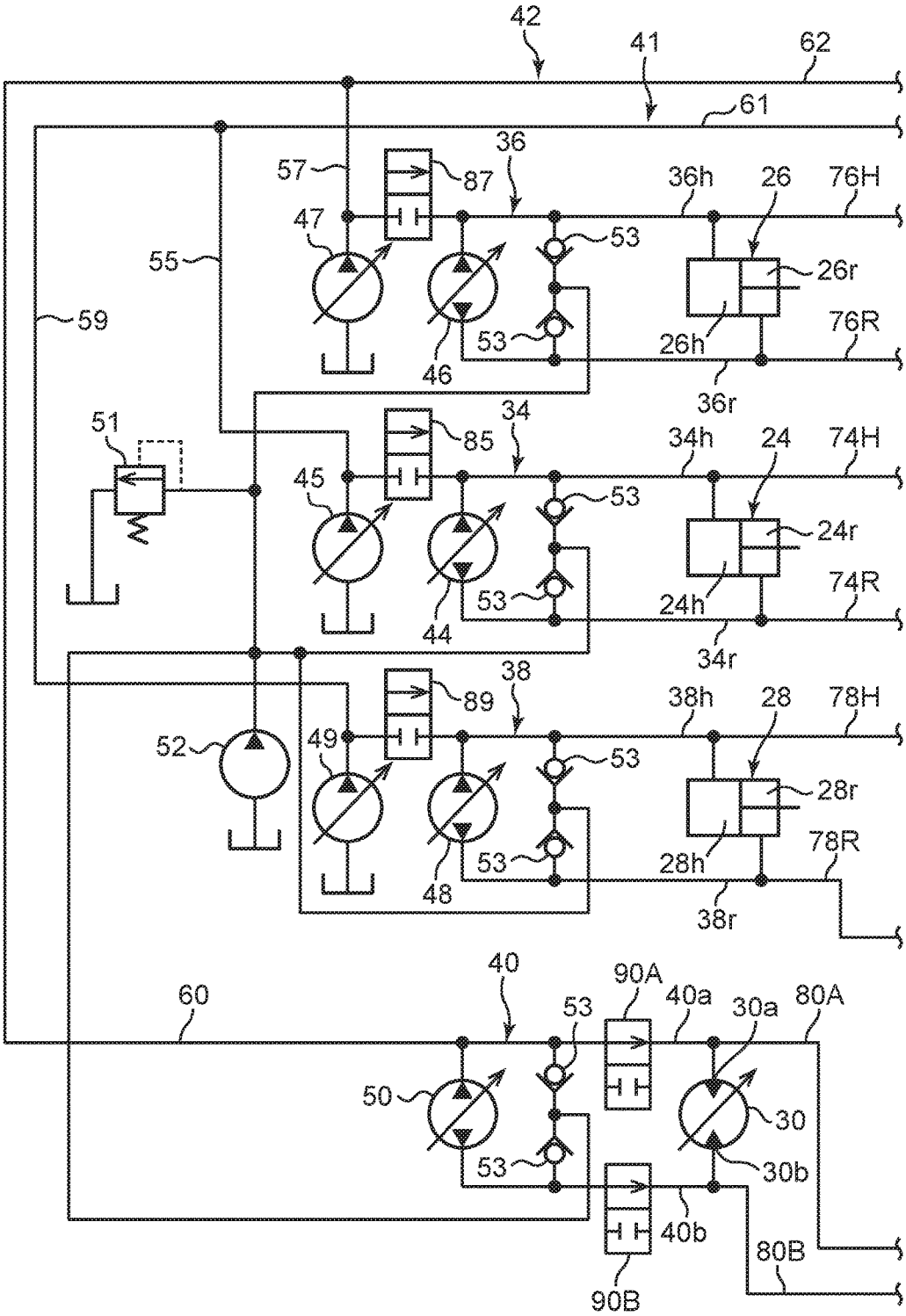
FIG. 5 is a circuit diagram showing a main part of a hydraulic drive device according to a second embodiment of the present invention.

The configuration of the circuit switching portion is not limited to that shown in FIG. 1. For example, as one of means for blocking the closed circuit in the realization of the second state, that is, the state in which the open circuit is selected, the closed-circuit on-off valves 84H, 84R, 86H, 86R, 88H, and 88R are provided in the pipes 34*h*, 34*r*, 36*h*, 36*r*, 38*h*, and 38*r* of the closed circuits 34, 36, and 38 according to the first embodiment. Instead of this, as another means, control may be performed to set the capacities (displacement volumes) of the closed-circuit pumps 44, 45, 47, and 49 to zero, and according to a second embodiment, as shown in FIG. 5, the on-off valves 85, 87, and 89 may be provided between the closed circuit 34, 36, and 38, and the open type pumps 45, 47, and 49 in the closed circuits 34, 36, and 38, respectively, to thereby close the on-off valves 85, 87, and 89 when the open circuit is used (when the second state is selected). In the second embodiment, just like the first embodiment, the hydraulic oil discharged by the open type pumps 45, 47, and 49 can be entirely supplied to the first open circuit 41 or the second open circuit 42.

Figure 6:
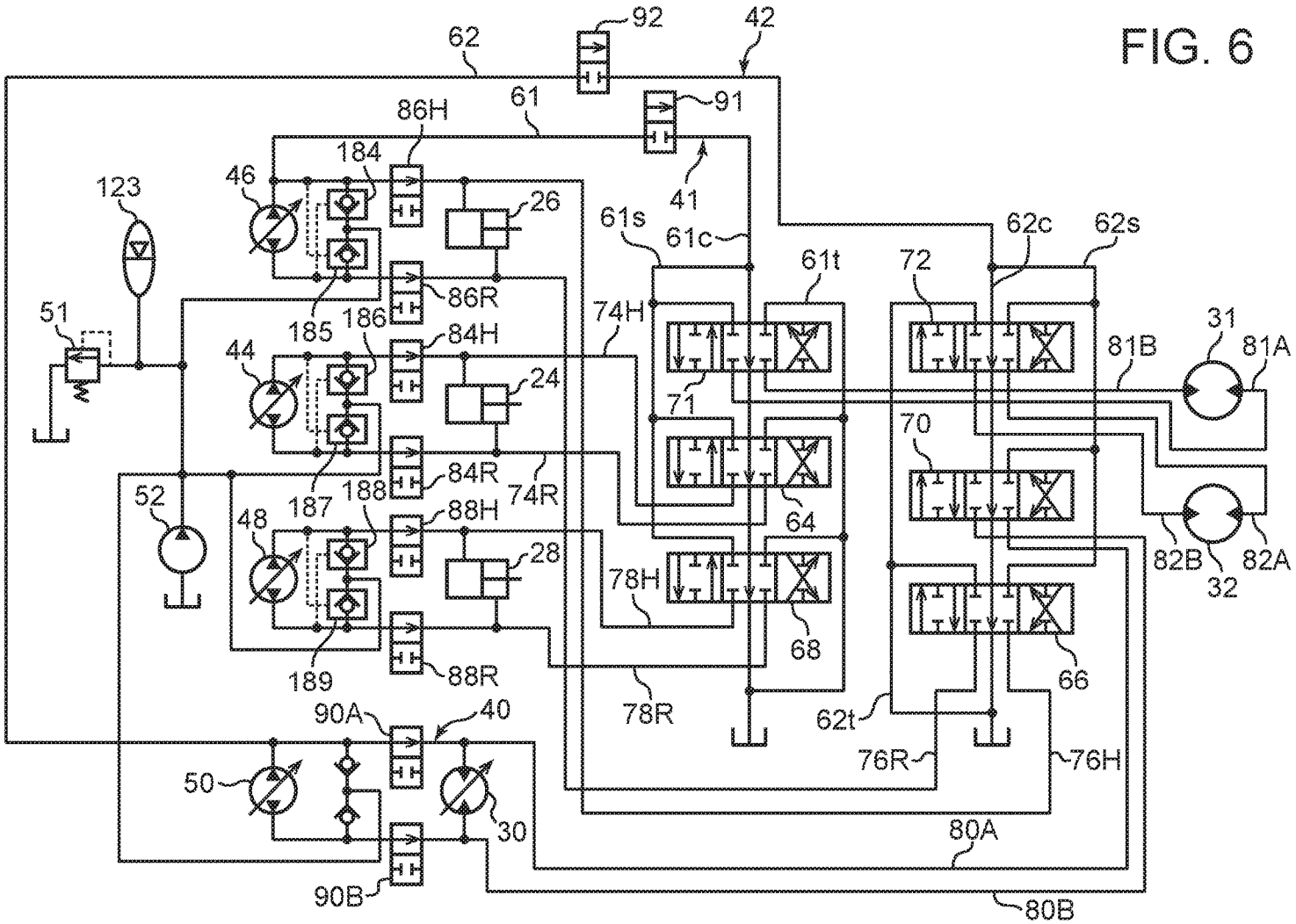
FIG. 6 is a circuit diagram showing a hydraulic drive device according to a third embodiment of the present invention.
Figure 7:
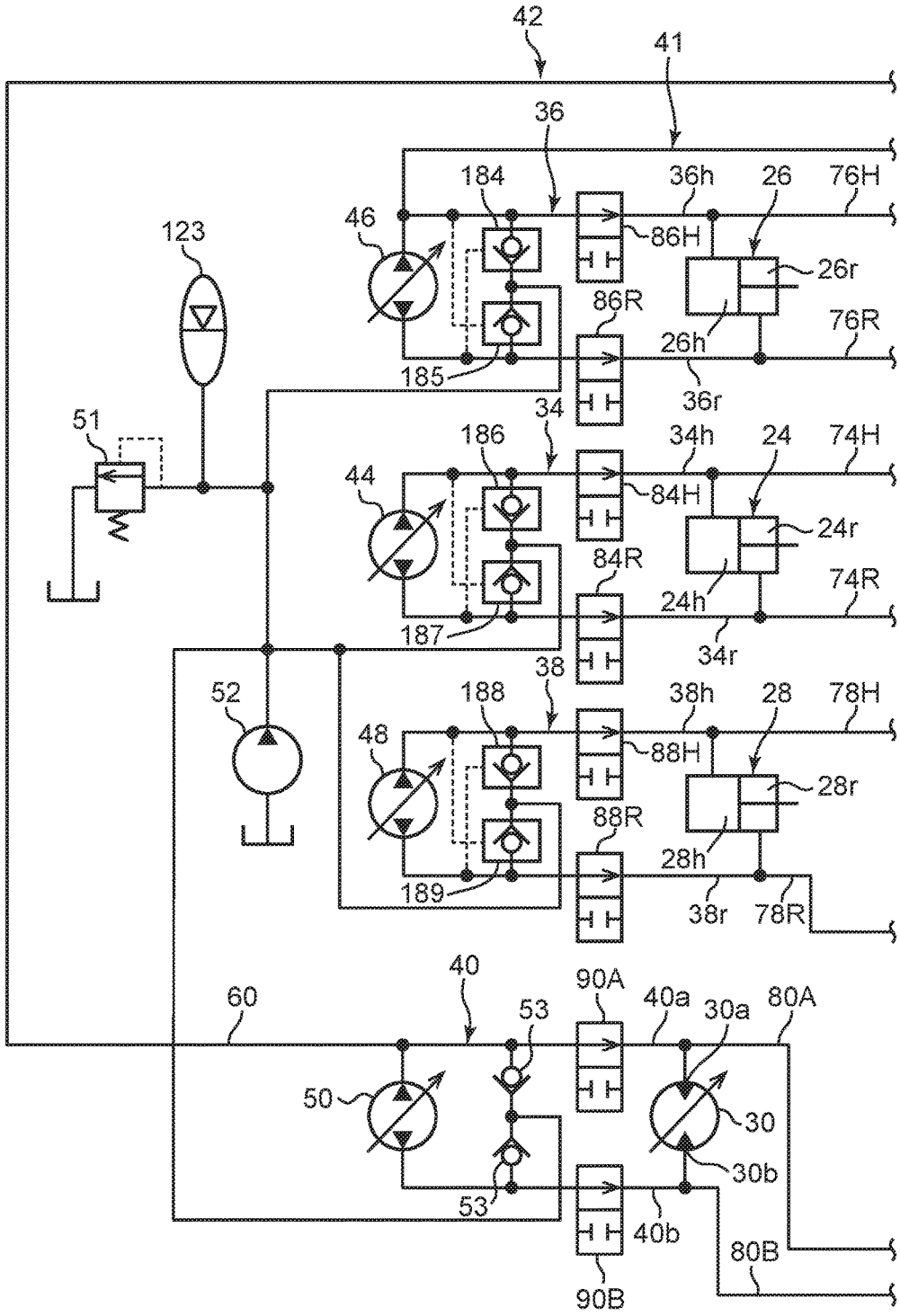
FIG. 7 is a circuit diagram showing a main part of the hydraulic drive device shown in FIG. 6.

FIGS. 6 and 7 show a hydraulic drive device according to a third embodiment of the present invention. The device according to the third embodiment differs from that according to the first embodiment only in the following points.

(A) Means for Eliminating the Area Difference Regarding the Hydraulic Cylinder with a Rod in a Closed Circuit In the device according to the third embodiment, the open type pumps 45, 47, and 49 according to the first embodiment are omitted. Further, as means for eliminating the area difference regarding the boom hydraulic cylinder 24, the arm cylinder 26, and the bucket cylinder 28 which are the hydraulic cylinders with the rods, the charge check valves 53 according to the first embodiment are replaced with pilot check valves 184, 185, 186, 187, 188, and 189 and a charge accumulator 123 is provided in parallel with the charge pump 52.

The pilot check valves 184, 185, 186, 187, 188, and 189 are connected to the head side pipe 36*h* and the rod side pipe 36*r* of the arm closed circuit 36, the head side pipe 34*h* and the rod side pipe 34*r* of the boom closed circuit 34, the head side pipe 38*h* and the rod side pipe 38*r* of the bucket closed circuit 38, respectively. In addition to the original function of the pilot check valves 184 to 189 for preventing the backflow of the hydraulic oil from the pipes 34*h*, 34*r*, 36*h*, 36*r*, 38*h*, and 38*r* to the tank, the pilot check valves 184 to 189 also have the function of loading a pressure of a pipe opposite to a pipe connected to the pilot check valve in each closed circuit (for example, the rod side pipe 34*r* of the boom closed circuit 34 when it comes to the pilot check valve 184 connected to the head side pipe 34*h* of the boom closed circuit 34), and of opening to allow the backflow when the loaded pilot pressure is at a certain level or more.

In this device, the combination of the pilot check valves 184 to 189 connected to the head side and rod side pipes of the closed circuits 34, 36, and 38, and the charge accumulator 123 makes it possible to eliminate the area difference between the head side chambers 24*h*, 26*h*, and 28*h* and the rod side chambers 24*r*, 26*r*, and 28*r* of the cylinders 24, 26, and 28, respectively. For example, when the boom hydraulic cylinder 24 is retracted to move the boom 18 in the downward direction, the hydraulic oil is discharged from the head side chamber 24*h* of the boom hydraulic cylinder 24 and the hydraulic oil is drawn into the rod side chamber 24*r*. At this time, the flow rate of the former discharged hydraulic oil becomes larger than the flow rate of the latter drawn hydraulic oil by the area of the rod. However, this flow rate difference is eliminated as the excess hydraulic oil is stored in the charge accumulator 123 by opening the pilot check valve 184 connected to the head side pipe 34*h* with the increase of the pilot pressure from the rod side pipe 34*r*. Conversely, when the boom hydraulic cylinder 24 is extended to move the boom 18 in the upward direction, the hydraulic oil is drawn into the head side chamber 24*h* of the boom hydraulic cylinder 24 and the hydraulic oil is discharged from the rod side chamber 24*r*, whereby the flow rate of the former drawn hydraulic oil becomes larger than the flow rate of the latter discharged hydraulic oil by the area of the rod. However, this flow rate difference is eliminated by supply of the hydraulic oil from the charge accumulator 124 or the charge pump 52 through the pilot check valve 184.

(B) Hydraulic Pump Connected to Open Circuit

In the device according to the first embodiment, the boom and bucket open type pumps 45 and 49 are connected to the first open circuit 41 including the boom control valve 64 and the bucket control valve 68, and the arm open type pump 47 and the turning closed-circuit pump 50 are connected to the second open circuit 42 including the arm control valve 66 and the turning control valve 70, whereas in the device according to the third embodiment, the arm closed-circuit pump 46 is connected to the first open circuit 41, and the turning closed-circuit pump 50 is connected to the second open circuit 42.

That is, in the third embodiment, the arm closed-circuit pump 46 for driving the arm cylinder 26 is connected to the first open circuit 41, which does not include the arm control valve 66, for controlling the arm cylinder 26 among the first and second open circuits 41 and 42, and conversely, the second open circuit 42 including the arm control valve 66 is connected to the turning closed-circuit pump 50 without being connected to the arm closed-circuit pump 46.

This enables the circuit switching portion to have a third state as well as the first state and the second state. In the first state, the closed circuits 34, 36, 38, 40 are opened and the first and second open circuits 41 and 42 are blocked. In the second state, the closed circuits 34, 36, 38, 40 are blocked and the first and second open circuits 41 and 42 are opened. In the third state, both arm closed circuit 36 corresponding to the arm closed-circuit pump 46 and the second open circuit 62 are opened, while only the first closed circuit 42 is blocked, thereby making it possible to supply the hydraulic oil to the arm cylinder 26 through the second open circuit 62 while circulating the hydraulic oil for driving the arm cylinder 26 to the arm closed circuit 36. In the third state, both the hydraulic oil circulating in the arm closed circuit 36 and the hydraulic oil passing through the second open circuit 62 from the turning closed-circuit pump 50 are supplied to an arm cylinder 36, in other words, are merged with each other, thereby enabling an increase in the speed of the arm cylinder 36.

Although the arm and turning closed-circuit pumps 46 and 50 do not have a function of directly drawing the hydraulic oil from the tank, the hydraulic oil supplied from the charge pump 52 to the arm and turning closed circuits 36 and 40 can be supplied to the first and second open circuits 41 and 42, just like the turning closed-circuit pump 50 according to the first embodiment.

The increase of the speed of the arm cylinder 36 is preferably performed when substantially only the operation of the arm cylinder 36 is performed, that is, when the operation that can be regarded as the arm single operation is substantially performed. This substantially arm single operation may imply, in addition to the operation being given only to the arm operation device 96, that the operation given to the turning operation device 100 is minute compared to the operation given to the arm operation device 96, and for example, that the operation given to the turning operation device 100 is equal to or less than a preset threshold value. Therefore, it is preferable that the circuit switching control unit 113 of the controller 110 switches the circuit switching portion to the third state when the substantial arm single operation is performed.

Figure 8:
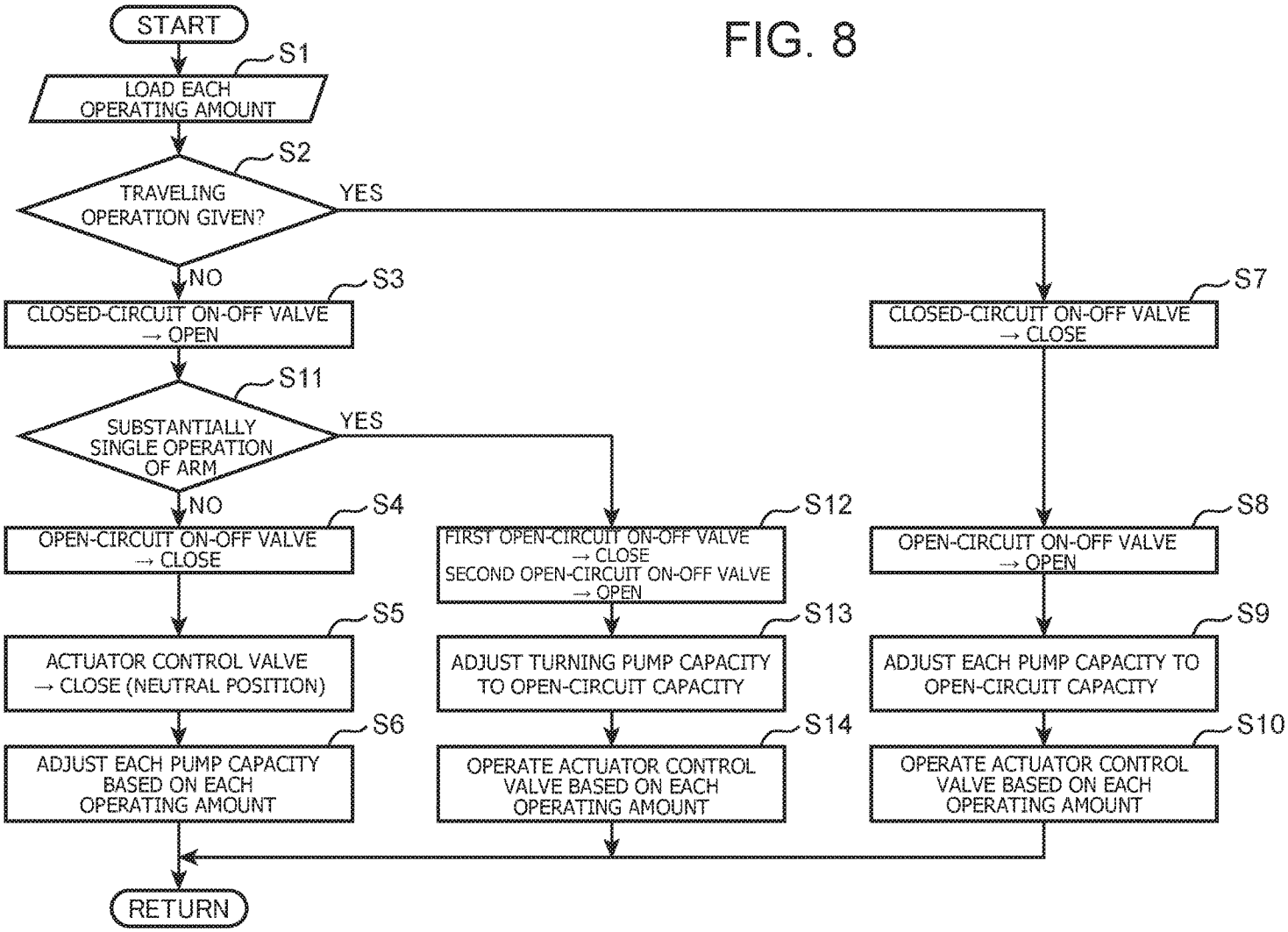
FIG. 8 is a flowchart showing a control operation of a controller included in the hydraulic drive device according to the third embodiment.

An example of the control operation is shown in the flowchart of FIG. 8. In this flowchart, the operations steps S1 to S10 are equivalent to those of the flowchart of FIG. 4. In the flowchart of FIG. 8, when there is no traveling operation (NO in step S2) and when the substantial arm single operation is being performed (YES in step S11), the operation of switching the circuit switching portion to the third state instead of the first state is performed.

Specifically, the circuit switching control unit 113 of the controller 110 opens each closed circuit on-off valve, and also closes the first open-circuit on-off valve 91 but opens the second circuit on-off valve 92 (step S12). Further, in order to enable the supply of the hydraulic oil to the arm cylinder 26 through the second open circuit 42 in the third state, the capacity of the turning closed-circuit pump 50 is adjusted to the open-circuit capacity (step S13). The arm control valve 66 and the turning control valve 70 are operated in accordance with the amount of operation given to the arm operation device 96 and the turning operation device 100 (step S14). Here, as the speed required for the turning motor 30 is minute, there is no problem with the turning drive even if most of the hydraulic oil discharged from the turning closed-circuit pump 50 is supplied to the arm cylinder 26.

Figure 9:
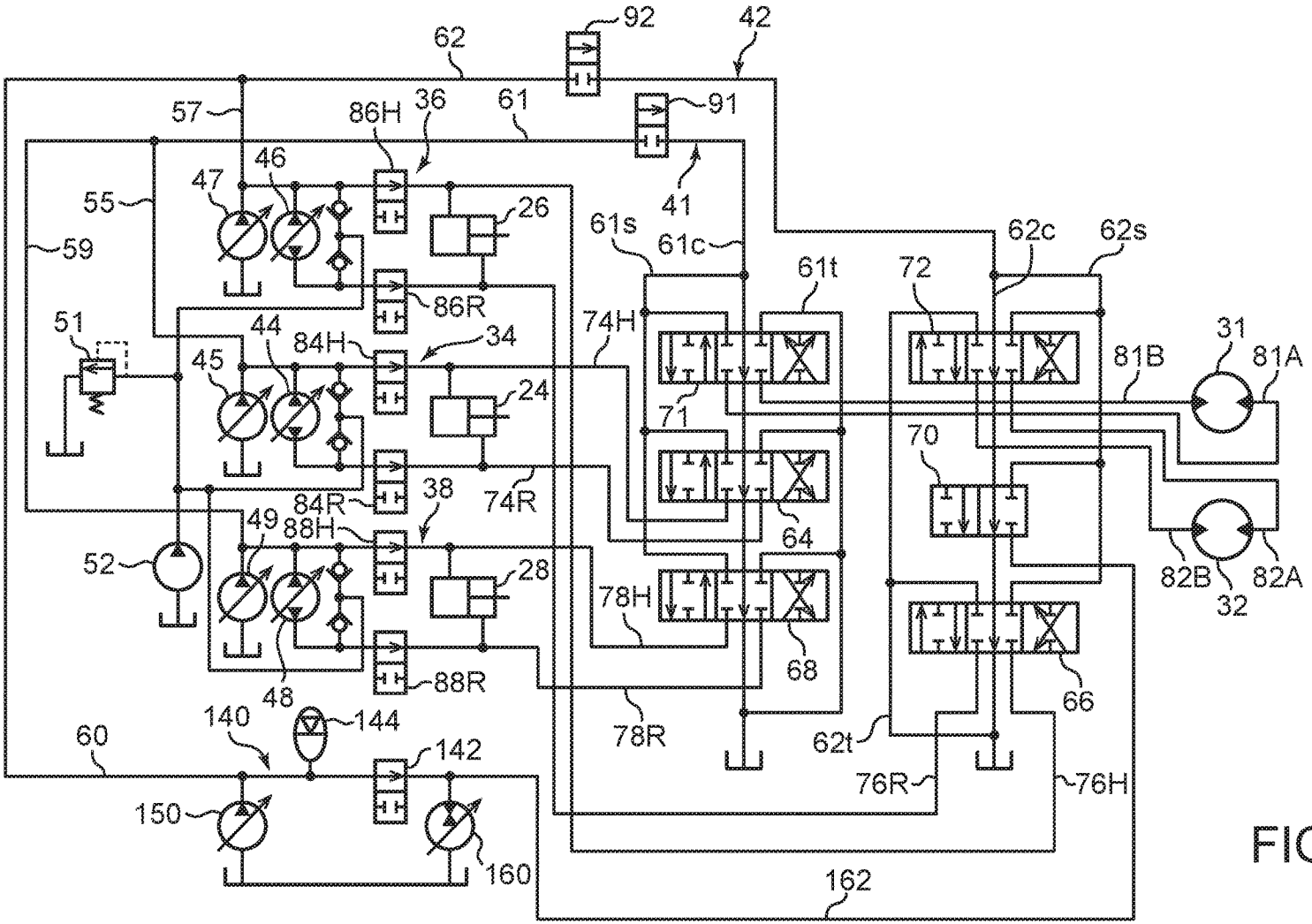
FIG. 9 is a circuit diagram showing a hydraulic drive device according to a fourth embodiment of the present invention.

The device according to the present invention may be the one that has at least a closed circuit and an open circuit, and does not exclude a device that includes a circuit other than the closed circuit and the open circuit. An example of this is shown in FIG. 9 as a fourth embodiment.

The device according to the fourth embodiment includes a so-called secondary circuit 140, instead of the turning closed circuit 40 according to the first embodiment as a circuit for driving the turning motor 30. More specifically, a turning open type pump 150 and a turning motor/pump 160 are provided instead of the turning closed-circuit pump 50 and the turning motor 30 according to the first embodiment. The turning pump/motor 160 is the hydraulic device capable of switching the capacity as to have both functions as a hydraulic pump and a hydraulic motor. The turning open type pump 150 is connected to the line 60 of the second open circuit 42, like the turning closed-circuit pump 50 of the first embodiment, and the turning motor/pump 160 is connected to the turning control valve 70A in the second open circuit 42 via a line 162.

In the secondary circuit 140, an on-off valve 142 is provided between the turning open type pump 150 and the turning motor/pump 160. An accumulator 144 for regeneration is provided between the on-off valve 142 and the turning open type pump 150.

In the first state, that is, in a state in which the closed-circuit on-off valves 74H, 74R, 76H, 76R, 78H, and 78R of the other actuators for work are opened, the on-off valve 142 is also opened. Here, during acceleration of the turning, the turning motor/pump 160 functions as a hydraulic motor, and receives the hydraulic oil supplied from the turning open type pump 150 and the accumulator 144 to turn the upper structure 14. Conversely, during deceleration of the turning, the turning motor/pump 160 functions as a hydraulic pump, and draws the hydraulic oil in the tank to introduce it into the accumulator 144, thereby enabling regeneration of energy during deceleration of the turning. Moreover, as the secondary circuit 140 does not include a variable throttle valve, the secondary circuit 140 can contribute to improvement of the energy saving effect, just like other closed circuits 34, 36, and 38.

In the second state, that is, in a state in which the closed-circuit on-off valves 74H, 74R, 76H, 76R, 78H, and 78R of the other actuators for work are closed, the on-off valve 142 is also closed. In this state, the turning open type pump 150 can contribute to the supply of the hydraulic oil to the second open circuit 42. As the turning control valve 70A is operated in the second state, the turning motor/pump 160 can be driven as a hydraulic motor by the hydraulic oil supplied to the second open circuit 42.

In the present invention, regardless of the number of hydraulic actuators included in the first actuator group and the second actuator group, for example, only a single hydraulic actuator may be included in the first actuator group or the second actuator group. Further, although a plurality of open circuits is provided as described above, only a single open circuit may be provided, and a plurality of variable throttle valves may be arranged in parallel in the open circuit, instead of in series. However, providing a plurality of open circuits connected to different hydraulic pumps, such as the first and second open circuits 41 and 42, can reduce the influence of an increase or decrease in the flow rate of the hydraulic oil supplied to one hydraulic actuator on the driving of other actuators.

Each operation device according to the present invention is not limited to the above described electric operation device. For example, a remote control valve may be used in which a pilot pressure corresponding to the operation of the lever is directly supplied to each of the actuator control valves. In this case, by providing a pilot pressure detector for detecting the pilot pressure and inputting the detection signal to the circuit switching control unit, the circuit switching control unit can switch the circuit switching portion between the first state and the second state according to each operation.

As described above, a hydraulic drive device is provided in a work machine, includes a plurality of hydraulic actuators, and is capable of obtaining a high energy saving effect with a low cost configuration.

The device provided includes the first actuator group, the second actuator group, at least one closed circuit, a pump section, at least one open circuit, and the circuit switching portion. The first actuator group includes at least one hydraulic actuator. The second actuator group includes at least one hydraulic actuator that differs from the hydraulic actuator included in the first actuator group. The at least one closed circuit is connected to the respective hydraulic actuators included in the first actuator group and forms the oil path for circulating the hydraulic oil for driving the hydraulic actuator. The pump section includes at least one hydraulic pump for circulating the hydraulic oil in the closed circuit. In the pump section, the at least one hydraulic pump includes a closed circuit pump, which is a variable displacement hydraulic pump provided in the closed circuit. The at least one open circuit is to connect at least a part of the at least one hydraulic pump included in the pump section to the plurality of the hydraulic actuators included in the first and second actuator groups. The at least one open circuit includes a plurality of variable throttle valves provided in the respective hydraulic actuators so as to change the flow rate of hydraulic oil, supplied from the hydraulic pump included in the pump section to the respective hydraulic actuators. The circuit switching portion has the first state which the closed circuit is opened and the open circuit is blocked, and the second state in which the closed circuit is blocked and the open circuit is opened. The first state allows the hydraulic actuator included in the first actuator group to be driven by the hydraulic oil circulating through the closed circuit, and the second state allows the hydraulic oil to be supplied from the hydraulic pump connected with the open circuit, to each of the hydraulic actuators through each of the variable throttle valves.

The device has both a closed circuit for driving the hydraulic actuators included in the first actuator group and an open circuit for driving the hydraulic actuators included in the first and second actuator groups, and at least a part of the hydraulic pumps included in the pump section for circulating the hydraulic oil in the closed circuit is applied to the open circuit. Regarding the hydraulic actuators included in the second actuator group, it is possible to reduce the total number of necessary pumps by eliminating the necessity of the inclusion of the closed-circuit hydraulic pump and to minimize the use of the variable throttle valves included in the open circuit, thereby making it possible to obtain the high energy saving effect by reducing the pressure loss in the variable throttle valve. Specifically, when only the hydraulic actuator included in the first actuator group is driven, by switching the circuit switching portion to the first state, that is, by opening the closed circuit and blocking the open circuit, the hydraulic pump drives the hydraulic actuator by the hydraulic oil that circulates in the closed circuit, thereby making it possible to obtain the high energy saving effect by avoiding the use of the variable throttle valves that would generate the pressure loss. Meanwhile, when at least one hydraulic actuator included in the second actuator group is driven, by switching the circuit switching portion to the second state, that is, by closing the closed circuit and opening the open circuit, the hydraulic oil can be supplied to the hydraulic actuator from the pump section through the variable throttle valve corresponding to the hydraulic actuator. Therefore, it is not necessary to provide a dedicated hydraulic pump for the hydraulic actuator included in the second actuator group.

The pump section may include the closed-circuit pump as well as other hydraulic pumps. For example, when the hydraulic actuator is a hydraulic cylinder with a rod and has a head side chamber and a rod side chamber, it is preferable for the pump section to further include an open type hydraulic pump for supplying and discharging the hydraulic oil between the tank and the closed circuit so as to eliminate the difference between the cross-sectional area of the head side chamber and the cross-sectional area of the rod side chamber. As the open type hydraulic pump can draw the hydraulic oil into the tank, by connecting the open type hydraulic pump to the open circuit, it is possible to supply the hydraulic oil from the open type hydraulic pump to each hydraulic actuator through each variable throttle valve. Alternatively, the pump section may include, in addition to the closed circuit pump, a charge pump for supplying a shortage of the hydraulic oil from a tank to the closed circuit. In this case, by connecting the closed-circuit pump to the open circuit, the closed-circuit pump can supply the hydraulic oil supplied from the charge pump into the closed circuit to each of the hydraulic actuators through each of the variable throttle valves.

The hydraulic drive device may a plurality of operation devices provided for the respective hydraulic actuators included in the first actuator group and the second actuator group, the operation devices each being configured to receive an operation for driving the corresponding hydraulic actuator; and a circuit switching control unit that switches the circuit switching portion between a first state and a second state in response to the operations given to the operation devices. This makes it possible to automatically switch the circuit state based on the operation performed for each actuator.

For example, it is preferable that the circuit switching control unit switches the circuit switching portion to the first state when an operation is given only to the operation device corresponding to the hydraulic actuator included in the first actuator group, and switches the circuit switching portion to the second state when an operation is given to at least the operation device corresponding to the hydraulic actuator included in the second actuator group, among the plurality of operation devices.

Meanwhile, the hydraulic pump included in the pump section preferably includes a capacity adjusting unit for adjusting the capacity of the hydraulic pump in accordance with the states of the circuit switching portion. A preferable capacity adjusting unit is one that sets the capacity of the closed circuit pump to a capacity corresponding to an operation given to an operation device corresponding to the closed circuit pump when the circuit switching portion is in the first state, and sets the capacity of the hydraulic pump connected to the open circuit among the hydraulic pumps included in the pump section to an open-circuit capacity for securing a flow rate required for supplying the hydraulic oil to each hydraulic actuator through the open circuit when the circuit switching portion is in the second state.

The first actuator group may include a plurality of hydraulic actuators. For example, the first actuator group may include a first closed-circuit hydraulic actuator and a second closed-circuit hydraulic actuator different from each other, and the at least one closed circuit may include a first closed circuit connected to the first closed-circuit hydraulic actuator and a second closed circuit connected to the second closed-circuit hydraulic actuator. In this case, the at least one open circuit can include, among hydraulic pumps included in the pump section, a first open circuit connected to the hydraulic pump for circulating hydraulic oil to the first closed circuit and a second open circuit connected to the hydraulic pump for circulating hydraulic oil to the second closed circuit among the hydraulic pumps. In this way, the provision of a plurality of open circuits connected to different hydraulic pumps makes it possible to reduce the influence of an increase or decrease in the flow rate of the hydraulic oil supplied to one hydraulic actuator on the driving of other actuators, compared to the case where only a single open circuit is provided.

The second closed-circuit hydraulic actuator may be connected to the second open circuit, that is, an open circuit connected to a hydraulic pump for circulating hydraulic oil in the second closed circuit connected to the second closed-circuit hydraulic actuator itself, or may be connected to the first open circuit, that is, an open circuit connected to a hydraulic pump for circulating hydraulic oil in the first closed circuit connected to the first closed-circuit hydraulic actuator different from the second-closed circuit hydraulic actuator. In the latter case, the circuit switching portion can have, in addition to the first state and the second state, a third state in which the hydraulic oil for driving the second closed-circuit hydraulic actuator circulates in the second closed circuit and simultaneously the hydraulic oil is capable of being supplied to the second closed-circuit hydraulic actuator through the second open circuit, by blocking the first closed circuit and opening both the second closed circuit and the second open circuit. In the third state, both the hydraulic oil circulating in the second closed circuit and the hydraulic oil passing through the second open circuit from the hydraulic pump for the first closed circuit are supplied to the second closed-circuit hydraulic actuator, thereby making it possible to increase the speed of the second closed-circuit hydraulic actuator.

In the form in which the circuit switching portion has the third state as described above, it is preferable that the circuit switching control unit switches the circuit switching portion to the third state when substantially only the operation is performed on the second closed circuit hydraulic actuator, specifically, when the amount of operation on the first closed circuit hydraulic actuator is sufficiently small (for example, less than or equal to a preset threshold value) with respect to the amount of operation on the second closed circuit hydraulic actuator.

The hydraulic drive device according to the present invention is suitable, for example, for a working machine including a travel device and a working device. In this case, preferably, the first actuator group of the hydraulic drive device includes at least one hydraulic actuator for work that drives the work device, and the second actuator group includes at least one hydraulic actuator for traveling that drives the travel device. As the hydraulic actuator for work has a higher frequency of operation than the hydraulic actuator for traveling, driving the hydraulic actuator for work by a closed circuit, that is, a circuit that does not require a throttle element is effective for improving the energy saving effect. Meanwhile, the hydraulic actuator for traveling, which has a less demand to improve the energy saving effect than the hydraulic actuator for work, is included in the second actuator group, and the hydraulic pump for the closed circuit of the hydraulic actuator for work is used for driving the hydraulic actuator for traveling, so that the required number of hydraulic pumps can be reduced while making the energy saving effect effective.

The invention claimed is:

1. A hydraulic drive device for a work machine, the hydraulic device being provided in a work device, comprising:

a first actuator group including at least one hydraulic actuator;

a second actuator group including at least one hydraulic actuator that is different from the hydraulic actuator included in the first actuator group;

at least one closed circuit connected to each of the at least one hydraulic actuator included in the first actuator group and configured to form an oil passage through which hydraulic oil for driving the hydraulic actuator circulates;

a pump section including at least one hydraulic pump for circulating the hydraulic oil in the closed circuit, the at least one hydraulic pump including a closed circuit pump, which is a variable displacement hydraulic pump provided in the closed circuit;

at least one open circuit that connects at least a part of the at least one hydraulic pump included in the pump section to a plurality of hydraulic actuators included in the first and second actuator groups, the at least one open circuit including a plurality of variable throttle valves provided in the respective hydraulic actuators so as to change a flow rate of the hydraulic oil supplied from the hydraulic pump included in the pump section to each of the hydraulic actuators; and a circuit switching portion, wherein the circuit switching portion has a first state in which the closed circuit is opened and the open circuit is blocked, and a second state in which the closed circuit is blocked and the open circuit is opened, the first state allowing the hydraulic actuator included in the first actuator group to be driven by the hydraulic oil circulating through the closed circuit, and the second state allowing the hydraulic oil to be supplied from the hydraulic pump connected with the open circuit, to each of the hydraulic actuators through each of the variable throttle valves.

2. The hydraulic drive device for a work machine according to claim 1, wherein the first actuator group includes a hydraulic cylinder with a rod as the hydraulic actuator, the hydraulic cylinder including a head side chamber and a rod side chamber, and wherein the pump section includes the closed circuit pump provided in the closed circuit connected to the hydraulic cylinder with the rod, and an open type hydraulic pump for supplying and discharging hydraulic oil between a tank and the closed circuit so as to eliminate a difference between a cross-sectional area of the head side chamber and a cross-sectional area of the rod side chamber.

3. The hydraulic drive device for a work machine according to claim 1, wherein the pump section further includes a charge pump for supplying a shortage of hydraulic oil from a tank to the closed circuit, and wherein the closed circuit pump is connected to the open circuit such that the hydraulic oil supplied from the charge pump into the closed circuit is supplied to each of the hydraulic actuators through each of the variable throttle valves.

4. The hydraulic drive device for a work machine according to claim 1, further comprising:

a plurality of operation devices provided for the respective hydraulic actuators included in the first actuator group and the second actuator group, the operation devices each being configured to receive an operation for driving the corresponding hydraulic actuator; and a circuit switching control unit that switches the circuit switching portion between the first state and the second state in response to the operations given to the operation devices.

5. The hydraulic drive device for a work machine according to claim 4, wherein the circuit switching control unit switches the circuit switching portion to the first state when an operation is given only to the operation device corresponding to the hydraulic actuator included in the first actuator group, and the circuit switching control unit switches the circuit switching portion to the second state when an operation is given to at least the operation device corresponding to the hydraulic actuator included in the second actuator group, among the operation devices.

6. The hydraulic drive device for a work machine according to claim 1, further comprising a capacity adjusting unit for adjusting a capacity of the hydraulic pump included in the pump section in accordance with the states of the circuit switching portion.

7. The hydraulic drive device for a work machine according to claim 6, wherein when the circuit switching portion is in the first state, the capacity adjusting unit sets a capacity of the closed-circuit pump to a capacity corresponding to an operation given to the operation device that corresponds to the closed-circuit pump, and wherein when the circuit switching portion is in the second state, the capacity adjusting unit sets a capacity of the hydraulic pump connected to the open circuit among the at least one hydraulic pump included in the pump section to an open-circuit capacity for securing a flow rate required for supplying the hydraulic oil to each of the hydraulic actuators through the open circuit.

8. The hydraulic drive device for a work machine according to claim 1, wherein the first actuator group includes a first closed-circuit hydraulic actuator and a second closed-circuit hydraulic actuator that are different from each other, the at least one closed circuit includes a first closed circuit connected to the first closed-circuit hydraulic actuator and a second closed circuit connected to the second closed-circuit hydraulic actuator, and the at least one open circuit includes a first open circuit connected to the hydraulic pump for circulating the hydraulic oil to the first closed circuit among the at least one hydraulic pump included in the pump section, and a second open circuit connected to the hydraulic pump for circulating the hydraulic oil to the second closed circuit among the at least one hydraulic pump included in the pump section.

9. The hydraulic drive device for a work machine according to claim 8, wherein the second closed-circuit hydraulic actuator is connected to the first closed circuit, and the circuit switching portion further has a third state in which the first closed circuit is blocked and both the second closed circuit and the second open circuit are opened, the third state allowing the hydraulic oil for driving the second closed-circuit hydraulic actuator to circulate in the second closed circuit and simultaneously allowing the hydraulic oil to be supplied to the second closed-circuit hydraulic actuator through the second open circuit.

10. The hydraulic drive device for a work machine according to claim 9, wherein the circuit switching control unit switches the circuit switching portion to the third state when an operation on the second closed-circuit hydraulic actuator is performed and an amount of an operation on the first closed-circuit hydraulic actuator is equal to or less than a preset threshold value.

11. The hydraulic drive device for a work machine according to claim 1, wherein the hydraulic drive device is provided in the work machine that includes a travel device and a work device, the first actuator group includes at least one hydraulic actuator for work that drives the work device, and the second actuator group includes at least one traveling hydraulic actuator that drives the travel device.

12. The hydraulic drive device for a work machine according to claim 2, wherein the hydraulic drive device is provided in the work machine that includes a travel device and a work device, the first actuator group includes at least one hydraulic actuator for work that drives the work device, and the second actuator group includes at least one traveling hydraulic actuator that drives the travel device.

13. The hydraulic drive device for a work machine according to claim 3, wherein the hydraulic drive device is provided in the work machine that includes a travel device and a work device, the first actuator group includes at least one hydraulic actuator for work that drives the work device, and the second actuator group includes at least one traveling hydraulic actuator that drives the travel device.

14. The hydraulic drive device for a work machine according to claim 4, wherein the hydraulic drive device is provided in the work machine that includes a travel device and a work device, the first actuator group includes at least one hydraulic actuator for work that drives the work device, and the second actuator group includes at least one traveling hydraulic actuator that drives the travel device.

15. The hydraulic drive device for a work machine according to claim 5, wherein the hydraulic drive device is provided in the work machine that includes a travel device and a work device, the first actuator group includes at least one hydraulic actuator for work that drives the work device, and the second actuator group includes at least one traveling hydraulic actuator that drives the travel device.

16. The hydraulic drive device for a work machine according to claim 6, wherein the hydraulic drive device is provided in the work machine that includes a travel device and a work device, the first actuator group includes at least one hydraulic actuator for work that drives the work device, and the second actuator group includes at least one traveling hydraulic actuator that drives the travel device.

17. The hydraulic drive device for a work machine according to claim 7, wherein the hydraulic drive device is provided in the work machine that includes a travel device and a work device, the first actuator group includes at least one hydraulic actuator for work that drives the work device, and the second actuator group includes at least one traveling hydraulic actuator that drives the travel device.

18. The hydraulic drive device for a work machine according to claim 8, wherein the hydraulic drive device is provided in the work machine that includes a travel device and a work device, the first actuator group includes at least one hydraulic actuator for work that drives the work device, and the second actuator group includes at least one traveling hydraulic actuator that drives the travel device.

19. The hydraulic drive device for a work machine according to claim 9, wherein the hydraulic drive device is provided in the work machine that includes a travel device and a work device, the first actuator group includes at least one hydraulic actuator for work that drives the work device, and the second actuator group includes at least one traveling hydraulic actuator that drives the travel device.

20. The hydraulic drive device for a work machine according to claim 10, wherein the hydraulic drive device is provided in the work machine that includes a travel device and a work device, the first actuator group includes at least one hydraulic actuator for work that drives the work device, and the second actuator group includes at least one traveling hydraulic actuator that drives the travel device.

* * * * *